US009423752B2

(12) United States Patent
Kaneko et al.

(10) Patent No.: US 9,423,752 B2
(45) Date of Patent: Aug. 23, 2016

(54) IMAGE FORMING APPARATUS AND METHOD ADJUSTING IMAGE FORMING CONDITION

(71) Applicants: Satoshi Kaneko, Kanagawa (JP); Shinji Kato, Kanagawa (JP); Shuji Hirai, Ohta-ku (JP)

(72) Inventors: Satoshi Kaneko, Kanagawa (JP); Shinji Kato, Kanagawa (JP); Shuji Hirai, Ohta-ku (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/726,847

(22) Filed: Jun. 1, 2015

(65) Prior Publication Data

US 2015/0362879 A1 Dec. 17, 2015

(30) Foreign Application Priority Data

Jun. 11, 2014 (JP) ..... 2014-120376

(51) Int. Cl.

| | |
|---|---|
| ***G03G 15/08*** | (2006.01) |
| ***G03G 15/16*** | (2006.01) |
| ***G03G 21/14*** | (2006.01) |
| ***G03G 15/00*** | (2006.01) |

(52) U.S. Cl.

CPC ..... *G03G 15/556* (2013.01); *G03G 15/5058* (2013.01); *G03G 21/145* (2013.01); *G03G 2215/0161* (2013.01)

(58) Field of Classification Search

CPC ..... G03G 15/305; G03G 15/5058
See application file for complete search history.

(56) References Cited

U.S. PATENT DOCUMENTS

| | | | | |
|---|---|---|---|---|
| 6,564,021 | B1 * | 5/2003 | Nakai | G03G 15/0131 399/49 |
| 8,843,037 | B2 * | 9/2014 | Ogawa | G03G 15/0189 399/301 |
| 2009/0279914 | A1 * | 11/2009 | Iwasaki | G03G 15/161 399/71 |
| 2011/0097096 | A1 * | 4/2011 | Sueoka | G03G 15/1605 399/49 |
| 2012/0201552 | A1 | 8/2012 | Hirai et al. | |

(Continued)

FOREIGN PATENT DOCUMENTS

| | | |
|---|---|---|
| JP | 6-130767 | 5/1994 |
| JP | 7-271139 | 10/1995 |

(Continued)

OTHER PUBLICATIONS

Extended European Search Report issued Oct. 30, 2015 in Patent Application No. 15170933.4.

*Primary Examiner* — Clayton E LaBalle
*Assistant Examiner* — Leon W Rhodes, Jr.
(74) *Attorney, Agent, or Firm* — Oblon, McClelland, Maier & Neustadt, L.L.P

(57) ABSTRACT

An image forming apparatus includes an image bearer; a toner image forming device; a transfer rotator; a transfer device; a rotation position detector; an image density detector; a density data acquisition unit to causes the toner image forming device to form an adjustment toner image equal to or greater in length than a circumferential length of the image bearer, cause a linear velocity difference between the image bearer and the transfer rotator in transfer of the adjustment toner image, and acquires, from a detected image density of the toner image transferred from the image bearer, detected by the image density detector, image density unevenness data with reference to detection of a reference rotation position of one of the image bearer and a rotator; and a correction unit to adjust an image forming condition according to the reference rotation position, the image density unevenness data, and the linear velocity difference.

13 Claims, 18 Drawing Sheets

(56) References Cited

U.S. PATENT DOCUMENTS

| | | | | |
|---|---|---|---|---|
| 2012/0315054 | A1* | 12/2012 | Kubo | G03G 15/5058 399/49 |
| 2013/0108288 | A1 | 5/2013 | Kaneko et al. | |
| 2013/0108292 | A1 | 5/2013 | Suzuki et al. | |
| 2013/0243456 | A1 | 9/2013 | Kaneko et al. | |
| 2013/0243457 | A1 | 9/2013 | Kaneko et al. | |
| 2014/0169814 | A1 | 6/2014 | Uematsu et al. | |
| 2014/0268242 | A1 | 9/2014 | Kaneko et al. | |
| 2014/0270827 | A1 | 9/2014 | Muto et al. | |
| 2014/0270828 | A1 | 9/2014 | Suzuki et al. | |
| 2014/0301748 | A1 | 10/2014 | Suzuki et al. | |

FOREIGN PATENT DOCUMENTS

| | | |
|---|---|---|
| JP | 8-044168 | 2/1996 |
| JP | 2000-098675 | 4/2000 |
| JP | 2005-241925 | 9/2005 |
| JP | 2005-258386 | 9/2005 |
| JP | 2007-102126 | 4/2007 |
| JP | 2007-121741 A | 5/2007 |
| JP | 2008-304646 | 12/2008 |
| JP | 2009-015211 | 1/2009 |

* cited by examiner

IMAGE FORMING APPARATUS AND METHOD ADJUSTING IMAGE FORMING CONDITION

CROSS-REFERENCE TO RELATED APPLICATIONS

This patent application is based on and claims priority pursuant to 35 U.S.C. §119(a) to Japanese Patent Application No. 2014-120376, filed on Jun. 11, 2014, in the Japan Patent Office, the entire disclosure of which is hereby incorporated by reference herein.

BACKGROUND

1. Technical Field

Embodiments of the present invention generally relate to an image forming apparatus, such as a copier, a printer, a facsimile machine, and a multifunction peripheral (MFP) having at least two of copying, printing, facsimile transmission, plotting, and scanning capabilities, that forms a toner image; and a method of adjusting an image forming condition.

2. Description of the Related Art

In image forming apparatuses, image density becomes uneven due to various factors.

For example, the image density becomes uneven corresponding to a rotation cycle of a developer bearer. Such cyclic unevenness in image density may be suppressed by optically detecting a toner pattern on a latent image bearer and adjusting an image forming condition, such as a developing bias, according to a result of detection of the toner pattern.

SUMMARY

An embodiment of the present invention provides an image forming apparatus that includes an image bearer to rotate; a toner image forming device to form a toner image on the image bearer; a transfer rotator disposed opposing to the image bearer; a transfer device to transfer the toner image from the image bearer onto either the transfer rotator or a recording medium conveyed on the transfer rotator; a rotation position detector to detect a reference rotation position of one of the image bearer and a rotator that contributes to image formation; an image density detector to detect an image density of the toner image transferred from the image bearer; a density data acquisition unit; and a correction unit.

The density data acquisition unit causes the toner image forming device to form an adjustment toner image equal to or greater in length than the image bearer in a rotation direction of the image bearer, causes a linear velocity difference between the image bearer and the transfer rotator in transfer of the adjustment toner image, and acquires, from a detection result of the adjustment toner image generated by the image density detector, image density unevenness data with reference to detection of the reference rotation position. The image density unevenness data includes an image density unevenness component having a rotation cycle of one of the image bearer and the rotator. The correction unit adjusts an image forming condition according to the detection of the reference rotation position, the image density unevenness data, and the linear velocity difference.

In another embodiment, an image forming apparatus includes a sheet conveyor to rotate, disposed opposing to the transfer rotator, in addition to the image bearer, the toner image forming device, the transfer rotator, the transfer device, the rotation position detector, the density data acquisition unit, and the correction unit. The transfer device transfers the toner image from the image bearer onto the transfer rotator and further onto a recording medium conveyed on the sheet conveyor. The rotation position detector to detect a reference rotation position of at least one of the image bearer, the sheet conveyor, and a rotator that contributes to image formation. The density data acquisition unit causes the toner image forming device to form an adjustment toner image equal to or greater in length than the image bearer in a rotation direction of the image bearer, causes a linear velocity difference one of between the image bearer and the transfer rotator, and between the transfer rotator and the sheet conveyor in transfer of the adjustment toner image, and acquire, from a detection result of the adjustment toner image generated by the image density detector, image density unevenness data with reference to detection of the reference rotation position. The image density unevenness data includes an image density unevenness component having a rotation cycle of the one of the image bearer, the sheet conveyor, and the rotator. The correction unit adjusts an image forming condition according to the detection of the reference rotation position, the image density unevenness data, and the linear velocity difference.

Yet another embodiment provides a method of adjusting an image forming condition. The method includes forming the above-described adjustment toner image on an image bearer; transferring the adjustment toner image from the image bearer onto a transfer rotator in a state in which a linear velocity difference is present between the image bearer and the transfer rotator; detecting a reference rotation position of one of the image bearer and a rotator that contributes to image formation; detecting an image density of the adjustment toner image on the transfer rotator; acquiring, from the image density detected, image density unevenness data with reference to detection of the reference rotation position; and adjusting the image forming condition according to the detection of the reference rotation position, the image density unevenness data, and the linear velocity difference. The image density unevenness data includes an image density unevenness component having a rotation cycle of the one of the image bearer and the rotator.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
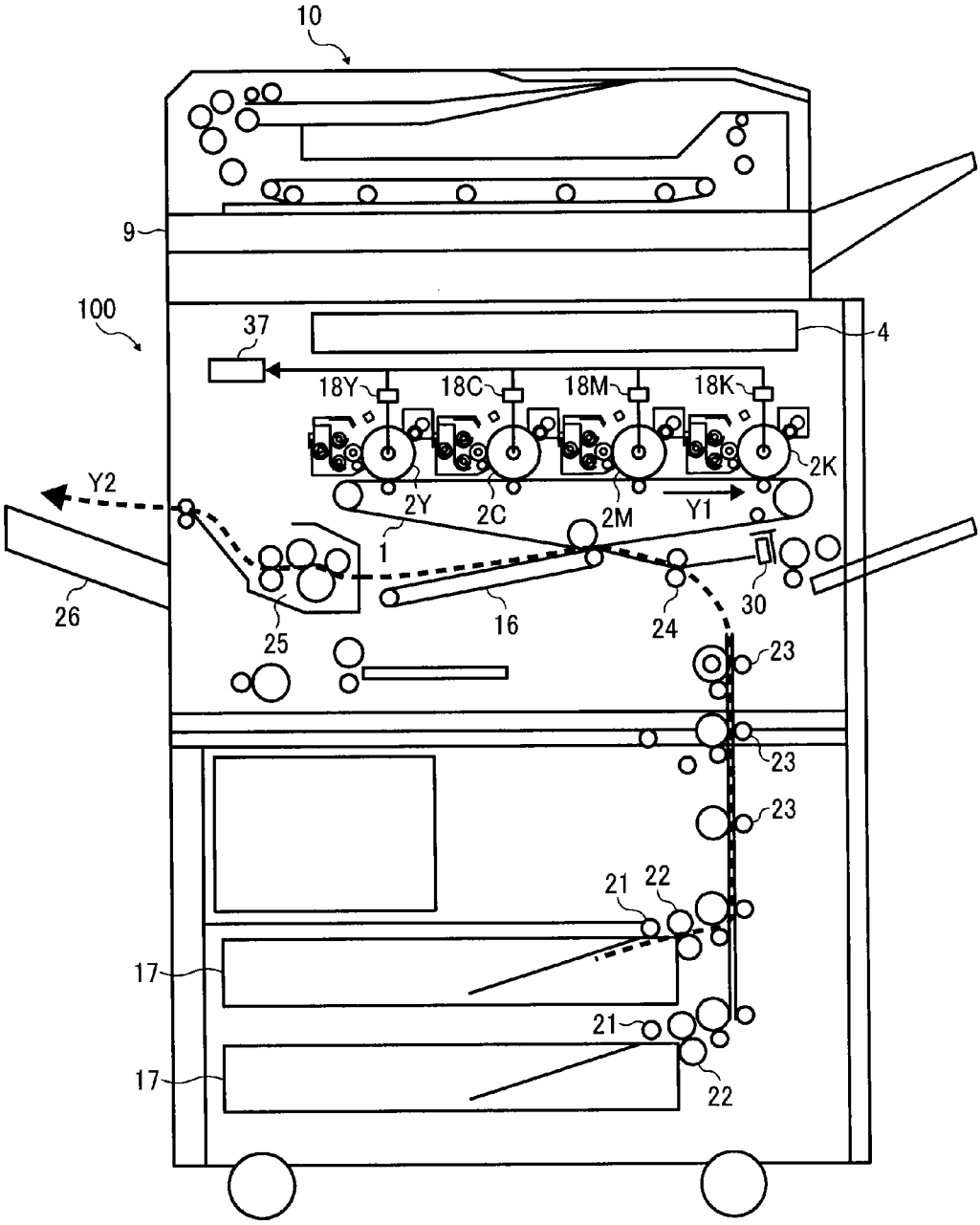
FIG. 1 is a schematic view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

There are image forming apparatuses in which a linear velocity of the latent image bearer is made different from that of an intermediate transfer member (i.e., a transfer rotator) in image formation to inhibit image failure called "wormhole images" (or center area void), which is a phenomenon that toner is absent in a center portion of an image as if the image is eaten by a worm.

Regarding mage forming apparatuses in which a linear velocity of a latent image bearer is made different from that of an intermediate transfer member (or a transfer rotator) in image formation, and an image forming condition is adjusted according to a result of detection of a toner pattern, the inventors recognize the following inconvenience. Although it is necessary to timely adjust image forming conditions in accordance with image density unevenness data based on the result of detection of the toner pattern to suppress cyclic unevenness in image density, the linear velocity difference between the latent image bearer and the intermediate transfer member hinders timely adjustment of the image forming conditions.

Typically, to adjust the image forming condition timely in accordance with the image density unevenness data, an identical reference is used to control an acquisition timing of a leading end of the image density unevenness data and a start timing of adjustment of image forming condition based on the image density unevenness data. For example, the reference is a detection timing of a reference position (home position) of the latent image bearer in the direction of rotation thereof. For example, descriptions are given below of a case where the distance from the development position to the position of detection by an image density sensor on an image transport route is a triple of the circumferential length of the latent image bearer and a developing bias is adjusted according to the image density unevenness data acquired from the detection result generated by the image density sensor.

In this configuration, acquisition of image density unevenness data from the detection result of the image density sensor is started with reference to a third detection of the home position after the home position is detected concurrently with arrival (or passing) of a reference position on the latent image bearer, at which a leading end of a toner pattern is positioned, at the development position. Then, during an image forming operation, the leading end of the image is formed at the reference position on the latent image bearer, and, upon detection of the home position that coincides with the time point at which the reference position passes through the development position, the adjustment of the developing bias according to the image density unevenness data is started. Such a sequence of operations is on the assumption that a travel time for the leading end of the toner pattern to move from the development position to the detection position of the image density sensor is equivalent to the length of time for the latent image bearer to make three revolutions. That is, if there is no difference in linear velocity between the latent image bearer and the intermediate transfer member, with this adjustment operation, the image forming condition can be adjusted timely according to the image density unevenness data, and uneven image density can be suppressed.

However, the linear velocity difference between the latent image bearer and the intermediate transfer member hinders timely adjustment of image forming condition according to the image density unevenness data because the travel time for the leading end of the toner pattern to move from the development position to the detection position of the image density sensor is not equivalent to the time for the latent image bearer to make three revolutions. This is because the speed at which the toner pattern moves from a primary transfer nip to the detection position of the image density sensor is identical to the linear velocity of the intermediate transfer belt, but the intermediate transfer belt 1 differs in linear velocity from the latent image bearer.

It is to be noted that the inconvenience described above occurs in, not only image forming apparatuses in which the latent image bearer is different in linear velocity from the intermediate transfer member, but also image forming apparatuses in which an image bearer (including an intermediate transfer member) is different in linear velocity from a sheet conveyor such as a conveyor belt to transport the sheet.

According to the embodiment described below, in an image forming apparatus in which images are formed in the state in which the image bearer is different in linear velocity from the transfer rotator, image failure such as wormhole images are suppressed, and the uneven image density is suppressed properly.

Figure 2:
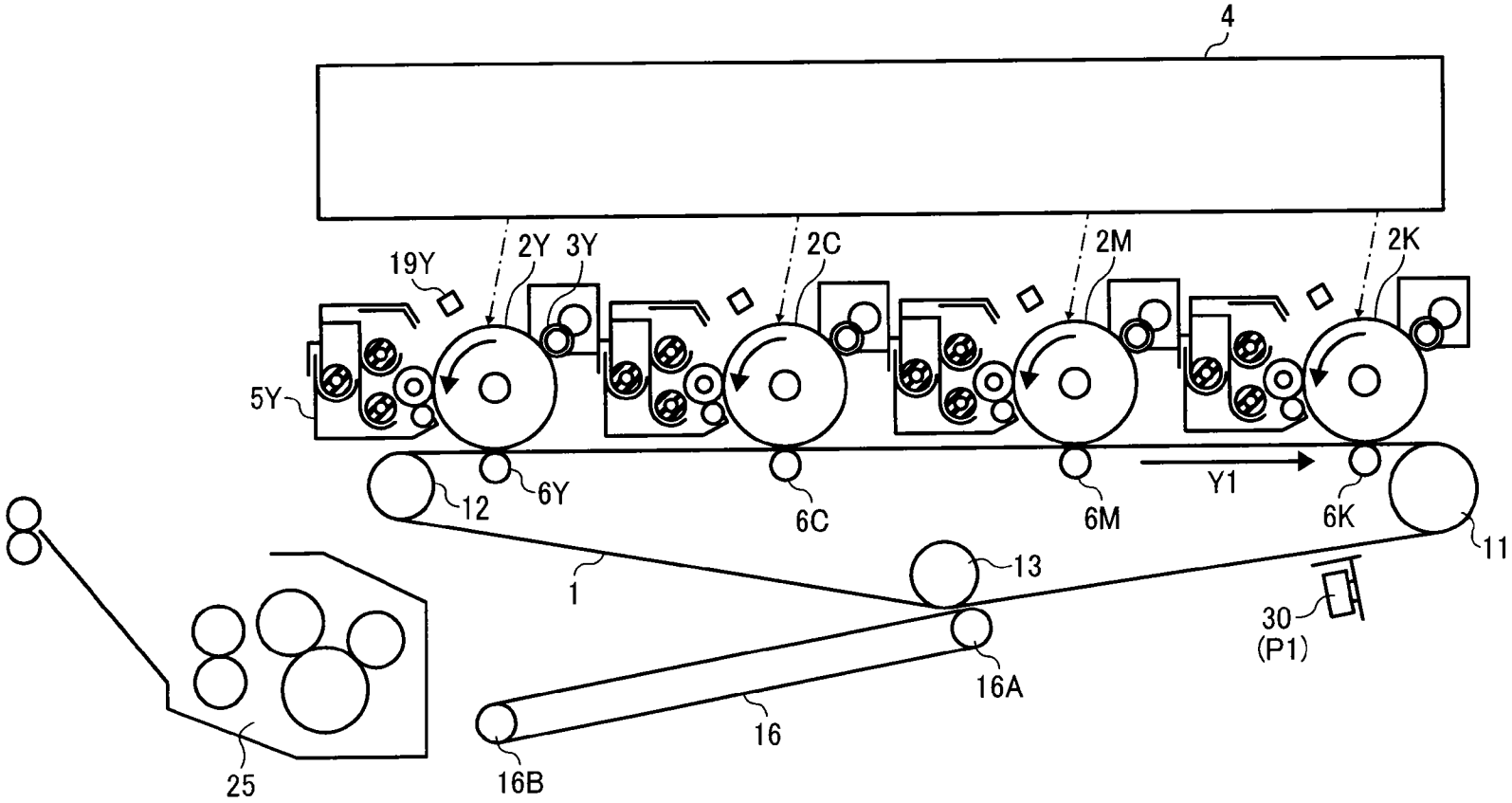
FIG. 2 is a schematic view of an image forming unit of the image forming apparatus illustrated in FIG. 1.

Referring now to the drawings, wherein like reference numerals designate identical or corresponding parts throughout the several views thereof, and particularly to FIGS. 1 and 2, a multicolor image forming apparatus according to an embodiment of the present invention is described.

Initially, a description is given of a configuration of an image forming apparatus 100 according to an embodiment of the present invention.

FIG. 1 is a schematic view of the image forming apparatus 100 according to the present embodiment. FIG. 2 is a partial view of a main part of the image forming apparatus 100.

In the present embodiment, the image forming apparatus 100 is a quadruple tandem intermediate transfer type image forming apparatus capable of multicolor (i.e., full-color) image formation. However, features of this specification can adapt to other types of image forming apparatuses, such as quadruple tandem direct transfer image forming apparatuses capable of full-color image formation, one drum full-color image forming apparatuses employing intermediate transfer, and one drum type monochrome image forming apparatuses employing direct transfer.

As illustrated in FIG. 1, the image forming apparatus 100 includes an intermediate transfer belt 1 serving as a transfer rotator and four image forming stations. In the image forming apparatus 100, four photoconductor drums 2Y, 2C, 2M, and 2K serving as latent image bearers are arranged side by side along a tensioned surface of the intermediate transfer belt 1. It is to be noted that suffixes Y, M, C, and K attached to each reference numeral indicate only that components indicated thereby are used for forming yellow, magenta, cyan, and black images, respectively, and hereinafter may be omitted when color discrimination is not necessary.

For example, in the image forming station for yellow, around the photoconductor drum 2Y, a charging roller 3Y serving as a charger, a right source for yellow of an optical writing unit 4, a surface potential sensor 19Y serving as a potential detector to detect surface potential of the photoconductor drum 2Y, and a developing device 5Y are arranged in that order in the direction indicated by arrow A illustrated in FIG. 3 (hereinafter "direction A"), in which the photoconductor drum 2 rotates. The optical writing unit 4 serves as a latent image forming device to irradiate the four photoconductor drums 2Y, 2C, 2M, and 2K with laser beams to write electrostatic latent images thereon. The charging roller 3Y, the optical writing unit 4, the developing device 5Y, and the like together serve as a toner image forming device 10 (in FIG. 11) to form a yellow toner image on the photoconductor drum 2Y. It is to be noted that other image forming stations have configurations similar to that of the yellow image forming station.

As illustrated in FIG. 2, the intermediate transfer belt 1 is supported by support rollers 11, 12, and 13 rotatably in the direction indicated by arrow Y1 in FIG. 1 (hereinafter "travel direction Y1"). The intermediate transfer belt 1 is made of a less-stretchable resin material, such as polyimide, in which carbon powder is dispersed to adjust electrical resistance. The support roller 13 faces a secondary transfer belt 16 serving as a sheet conveyor or a rotator that contributes image formation. The secondary transfer belt 16 is rotatably supported by support rollers 16A and 16B. In the present embodiment, to prevent image failure, such as center area void meaning that toner is absent in a center portion of an image as if the image is eaten by worms (also "wormhole images"), the speed (i.e., linear velocity) at which the surface of the intermediate transfer belt 1 moves is made different from that of the photoconductor drum 2.

In another configuration, instead of the secondary transfer belt 16, the sheet may be interposed between the intermediate transfer belt 1 and the support roller 16A pressing against the support roller 13, forming a secondary transfer nip therebetween.

The optical writing unit 4 includes four laser diodes driven by a laser controller. The laser diodes emit the laser beams as writing light according to image data toward the surfaces the photoconductor drums 2 charged uniformly by the charging roller 3, and scans, with the respective laser beams, the photoconductor drums 2 in the dark. Then, electrostatic latent images are formed on the surfaces of the photoconductor drum 2. According to the present embodiment, the optical writing unit 4 further includes a polygon mirror that deflects the laser beam from the laser diode, a reflecting mirror that reflects the laser beam, and an optical lens through which the laser beam passes. Alternatively, in another embodiment, the optical writing unit 4 includes a light emitting diode (LED) array to irradiate the surfaces of the photoconductor drums 2 with laser beams.

Referring back to FIG. 1, the image forming apparatus 100 includes a scanner 9 and an automatic document feeder (ADF) 10 above the optical writing unit 4. In a lower portion of the image forming apparatus 100, sheet feeding trays 17 to accommodate sheets of recording media are provided. A pickup roller 21, a pair of feed rollers 22, pairs of conveyance rollers 23, and a pair of registration rollers 24 are provided along a sheet conveyance path Y2 indicated by the broken line starting from one of the sheet feeding trays 17 as an example. The pickup roller 21 picks up a sheet from the sheet feeding tray 17 to feed the sheet to the pair of feed rollers 22. The pair of feed rollers 22 feeds the sheet to the pairs of conveyance rollers 23, which convey the sheet to the pair of registration rollers 24. The pair of registration rollers 24 sends out the sheet at a predetermined time toward a secondary transfer area called the secondary transfer nip formed between the intermediate transfer belt 1 and the secondary transfer belt 16. A fixing device 25 is disposed on the sheet conveyance path Y2 downstream from the secondary transfer nip in the direction in which the sheet is conveyed.

The surface potential sensors 19 detect potential of the electrostatic latent images on the photoconductor drums 2 formed by the optical writing unit 4, that is, the surface potential of the photoconductor drums 2 before the developing devices 5 develop the electrostatic latent images into visible toner images. The surface potential thus detected is used to determine settings of image forming conditions such as a charging bias of the charging rollers 3 and exposure power or laser power of the optical writing unit 4, thereby maintaining stable image density.

An output tray 26 is disposed downstream from the fixing device 25 in the direction in which the sheet is conveyed. The image forming apparatus 100 also includes an image density sensor 30 and a controller 37 that includes a central processing unit (CPU), a nonvolatile memory, a volatile memory, and the like.

In FIG. 1, reference characters 18Y, 18C, 18M, and 18K represent photointerrupters.

Figure 3:
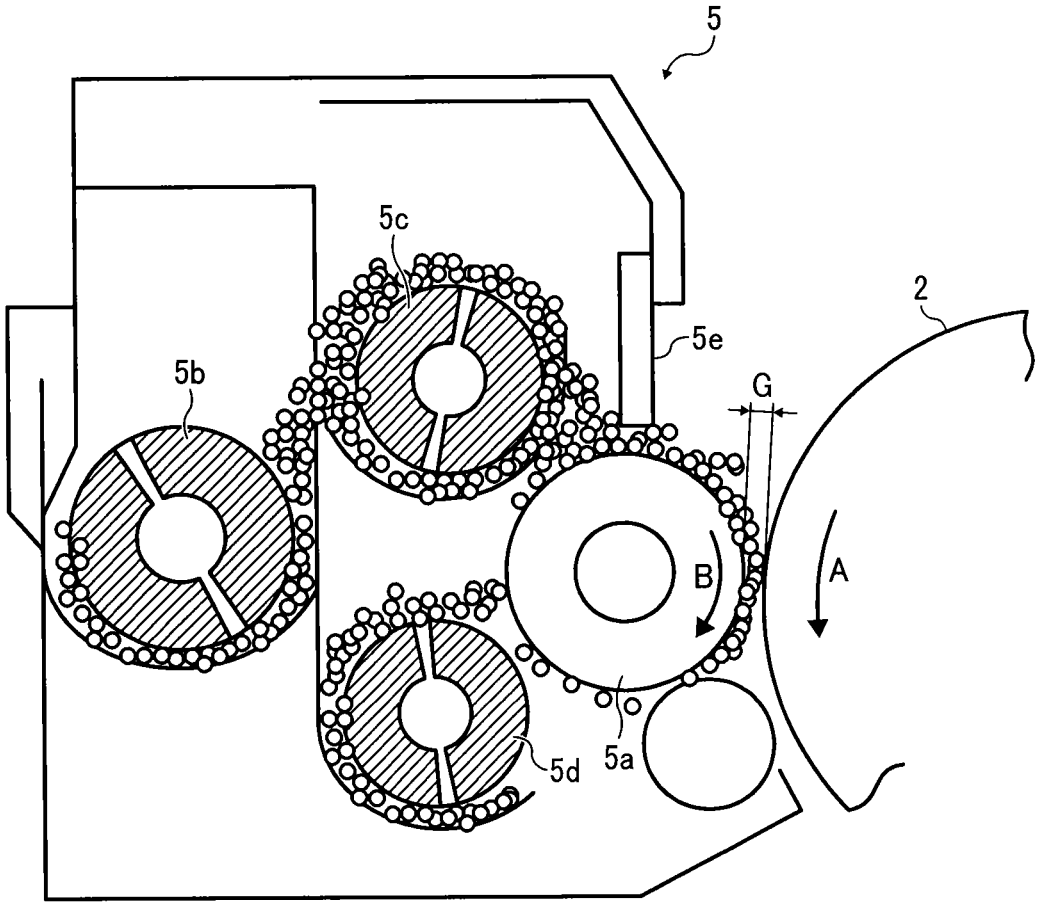
FIG. 3 is a schematic view of a developing device incorporated in the image forming unit illustrated in FIG. 2.

Referring now to FIG. 3, a detailed description is given of the developing devices 5. FIG. 3 is a schematic view of one of the developing devices 5. The developing devices 5 are identical in configuration. Therefore, in the following description and FIG. 3, the suffixes Y, M, C, and K are omitted.

As illustrated in FIG. 3, the developing device 5 includes a developing roller 5*a* serving as a developer bearer (i.e., a rotator that contributes image formation) close to the surface of the photoconductor drum 2, with a developing gap G secured between the developing roller 5*a* and the surface of the photoconductor drum 2. The developing roller 5*a* bears two-component developer containing toner and carrier, and supplies the toner to the surface of the photoconductor drum 2 in a developing range facing the photoconductor drum 2. Thus, the developing device 5 develops the electrostatic latent image formed on the photoconductor drum 2 into a visible toner image.

In a casing (serving as a developer container) of the developing device 5, a stirring screw 5*b* serving as a developer stirrer, a supply screw 5*c*, and a collecting screw 5*d* are disposed in parallel with the developing roller 5*a*. The stirring screw 5*b* conveys the developer to an end of the stirring screw 5*b* on the front side of the paper on which FIG. 3 is drawn while stirring the developer, and further to the supply screw 5*c* through an opening. The supply screw 5*c* conveys the developer along the developing roller 5*a* while stirring the developer to supply the developer onto a surface of the developing roller 5*a*. A magnetic field generator disposed inside the developing roller 5*a* generates a magnetic field so that the developing roller 5*a* bears the developer on the surface thereof and conveys the developer in the direction indicated by arrow B in which the developing roller 5*a* rotates.

Figure 19A:
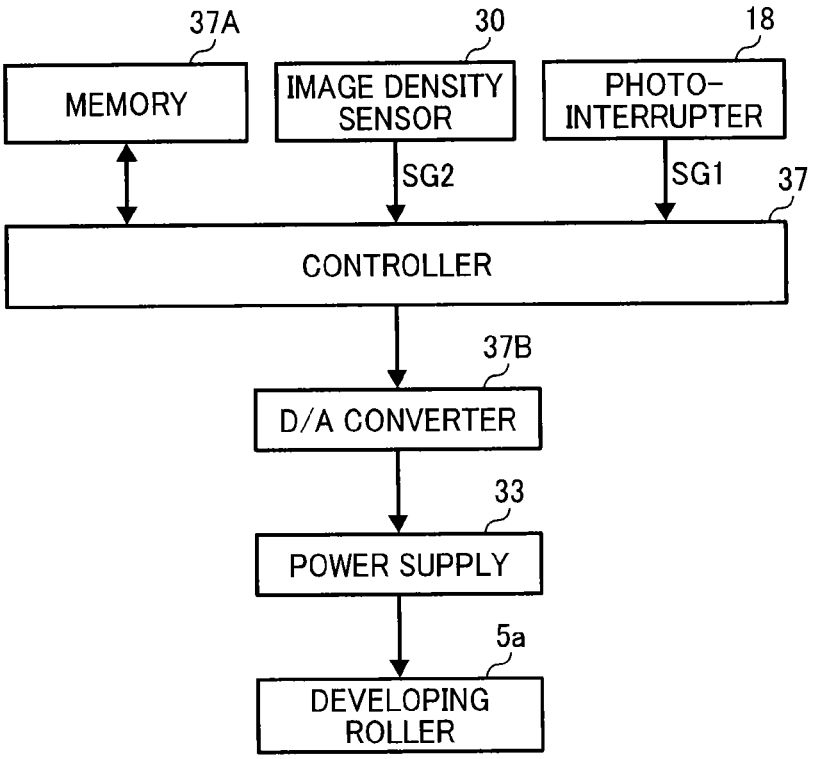
FIG. 19A is a block diagram illustrating a configuration to execute the adjustment method illustrated in FIG. 18.
Figure 19B:
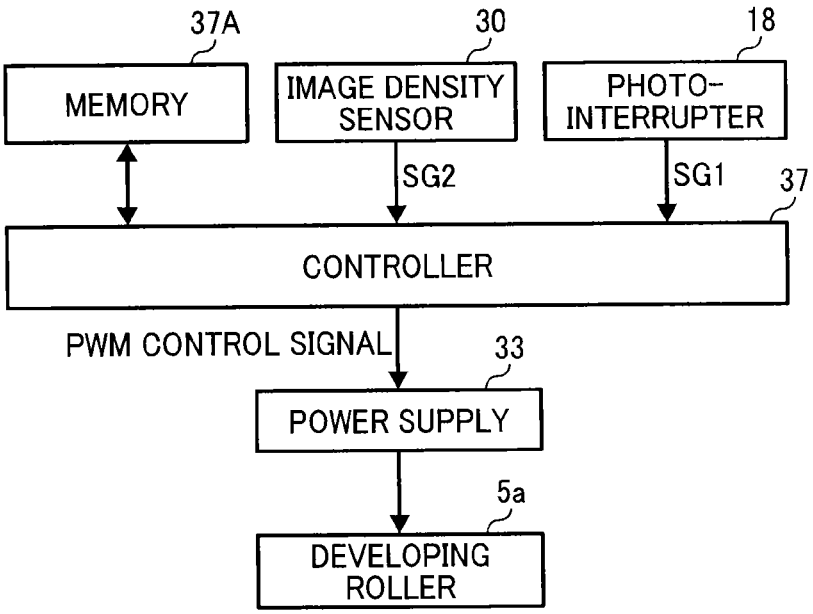
FIG. 19B is a block diagram illustrating another configuration to execute the adjustment method illustrated in FIG. 18.

The developing device 5 also includes a doctor blade 5*e* serving as a developer regulator. After the doctor blade 5*e* regulates a layer height of developer borne on the surface of the developing roller 5*a*, the developer is conveyed by the rotation of the developing roller 5*a* to the developing range facing the surface of the photoconductor drum 2 rotating in the direction A. A developing bias is applied to the developing range by developing voltage applied to the developing roller 5*a* from a power supply 33, which is illustrated in FIGS. 19A and 19B. The developing bias forms an electrical developing field between the surface of the developing roller 5*a* and the electrostatic latent image formed on the photoconductor drum 2. The developing field causes toner to move to the electrostatic latent image, rendering the electrostatic latent image visible as a toner image. Thus, a developing process is performed. Note that the developing process consumes toner and reduces the ratio of toner in developer contained in the casing of the developing device 5. In response to such reduction of toner, a toner supplier supplies toner to the casing through an opening above the stirring screw 5*b*.

In the present embodiment, the developing roller 5*a* and the photoconductor drum 2 rotate in a forward direction, that is the developing roller 5*a* and the photoconductor drum 2 move in an identical direction in a contact portion therebetween (one stage developing in forward direction). However, developing type is not limited thereto. For example, in another embodiment, multistage developing using multiple developing rollers is employed. In yet another embodiment, reverse direction developing, in which the developing roller and the photoconductor drum rotate in the opposite directions, is employed. Additionally, in the present embodiment, two-component developer is used. Alternatively, in some embodiments, one-component developer that does not contain carrier is used.

The charging devices 3 charge uniformly the photoconductor drums 2. Subsequently, driven by a laser controller, four semiconductor lasers of the optical writing unit 4 emit laser beams in the dark to the charged surfaces of the photoconductor drums 2. With the laser beams, the optical writing unit 4 scans the surfaces of the photoconductor drums 2 in in the dark, thereby forming electrostatic latent images for yellow, cyan, magenta, and black thereon. According to the present embodiment, the optical writing unit 4 further includes a polygon mirror that deflects the laser beam from the laser diode, a reflecting mirror that reflects the laser beam, and an optical lens through which the laser beam passes. Instead of the above-described configuration, a light scanning mechanism employing a light-emitting diode (LED) array may be used.

A description is now given of an image forming operation with continued reference to FIG. 1.

In response to an input of a print start command, the rollers around the photoconductor drums 2, the intermediate transfer belt 1, and the sheet conveyance path Y2 start rotating at their predetermined timings, and a sheet is fed from one of the sheet feeding trays 17. Meantime, the charging rollers 3 charge the surfaces of the photoconductor drums 2 to uniform potential and the optical writing unit 4 irradiates or exposes the charged surfaces of the photoconductor drums 2 with laser beams according to image data of the respective colors to form electrostatic latent images (i.e., potential patterns after exposure) on the surfaces of the photoconductor drums 2. The developing rollers 5*a* of the developing devices 5 supply toner onto the surfaces of the photoconductor drums 2 bearing the electrostatic latent images, rendering the electrostatic latent images visible as toner images.

In the configuration shown in FIG. 1 that includes the four photoconductor drums 2 respectively corresponding to yellow (Y), magenta (M), cyan (C), and black (K), yellow, magenta, cyan, and black single-color images are formed on the photoconductor drums 2 (the order of colors differs depending on apparatus type). In primary transfer areas (also "primary transfer nips"), where the photoconductor drums 2 face and press against the intermediate transfer belt 1, primary transfer rollers 6 are disposed facing the respective photoconductor drums 2. In the primary transfer nips, the toner images on the photoconductor drums 2 are transferred onto the intermediate transfer belt 1 by primary transfer biases applied to the primary transfer rollers 6 and pressing force (i.e., a primary transfer process). While the primary transfer process is repeated for the four colors, the toner images are superimposed one on another on the intermediate transfer belt 1 as a multicolor toner image.

The pair of registration rollers 24 then conveys the sheet to the secondary transfer nip, where the full-color toner image is transferred from the intermediate transfer belt 1 onto the sheet by a secondary transfer bias and a pressing force applied to the secondary transfer belt 16. Then, the sheet bearing the full-color toner image thereon passes through the fixing device 25 that fixes the full-color toner image onto the sheet with heat and pressure. Then, the sheet is discharged onto the output tray 26.

The image density sensor 30 is an optical sensor that detects the amount of toner adhering to a unit area (hereinafter "toner adhesion amount") of a toner pattern, that is, image density of the toner pattern, formed on an outer circumferential face of the intermediate transfer belt 1. The image density sensor 30 detects the image density of a predetermined toner pattern formed in image quality adjustment (i.e., process control). The readings provided by the image density sensor 30 are used to determine the image forming conditions such as the charging bias of the charging rollers 3 and the exposure power or laser power of the optical writing unit 4, thereby maintaining stable image density.

Descriptions are given below of adjustment operation of image forming conditions in the image forming apparatus 100 according to the present embodiment. The image forming conditions are adjusted to suppress uneven image density.

In the adjustment operation, to inhibit uneven image density to enhance image quality, toner patterns for the adjustment (hereinafter "adjustment toner patterns"), described in detail later, are formed, and the image density of the adjustment toner patterns are detected.

Figure 4:
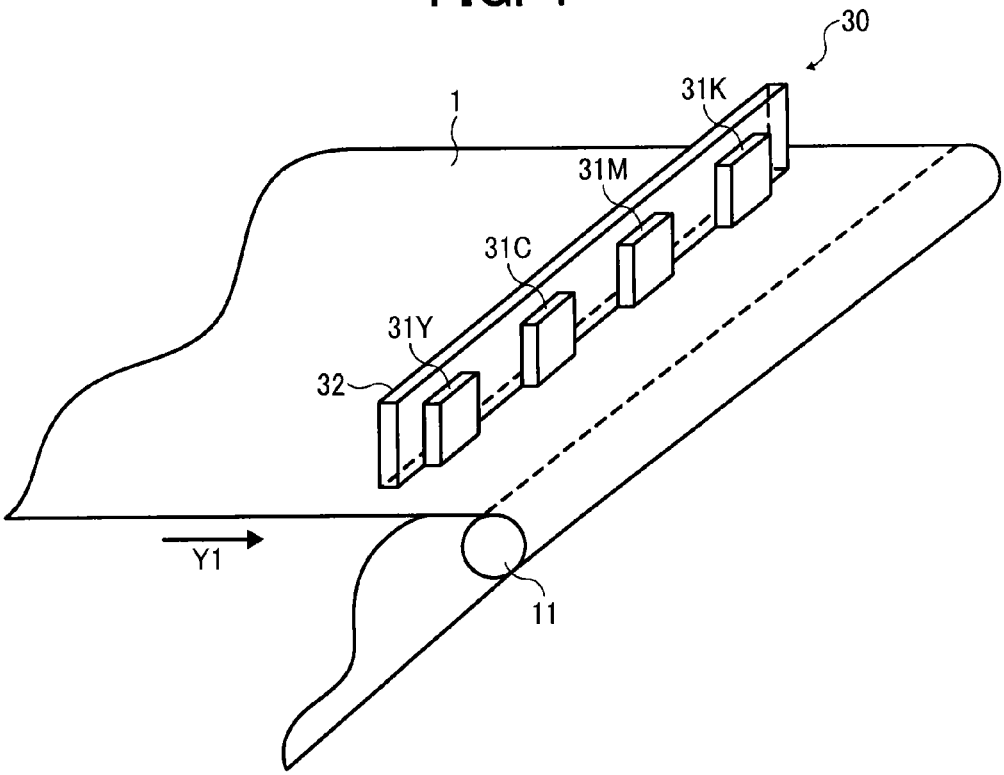
FIG. 4 is a perspective view of a position of an image density sensor according to an embodiment.

FIG. 4 is a perspective view of a position of the image density sensor 30 according to an embodiment.

In the arrangement illustrated in FIG. 4, the image density sensor 30 is disposed at a position P1 (in FIG. 2) upstream from the secondary transfer nip in the travel direction Y1 of the intermediate transfer belt 1. The image density sensor 30 is a four-head type sensor and includes a sensor board 32 and four sensor heads 31Y, 31C, 31M, and 31K (hereinafter correctively "sensor heads 31"), which are optical sensors, mounted on the sensor board 32. Accordingly, in the arrangement illustrated in FIG. 4, the four sensor heads 31 are arranged in the axial direction of the photoconductor drum 2, that is, a main scanning direction perpendicular to the travel direction Y1 of the intermediate transfer belt 1 (i.e., a sub-scanning direction).

This arrangement enables simultaneous measurement of the image density at four positions in the main scanning direction, and each sensor head 31 is dedicated for one of the four colors. It is to be noted that the number of the sensor heads 31 in the image density sensor 30 is not limited thereto. In another embodiment, an image density sensor including one, two, or three sensor heads is employed. In yet another embodiment, an image density sensor including five or more sensor heads is employed.

Figure 5:
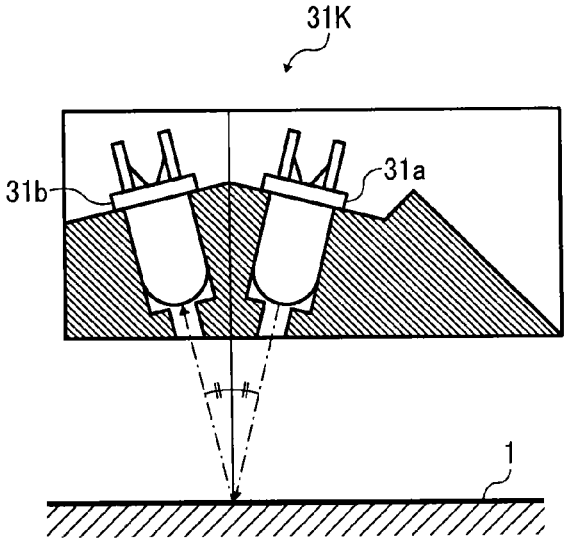
FIG. 5 is a schematic diagram of a sensor head for black of the image density sensor illustrated in FIG. 4.

FIG. 5 is a schematic diagram illustrating a configuration of the sensor head 31K for black.

As illustrated in FIG. 5, the sensor head 31K for black includes a light-emitting element 31*a*, which is, for example, a light emitting diode (LED), and a light-receiving element 31*b* to receive specular reflection of light. The light emitting element 31*a* emits light toward the outer circumferential face of the intermediate transfer belt 1, and the light-receiving element 31*b* receives specular reflection of the light reflected from the intermediate transfer belt 1.

Figure 6:
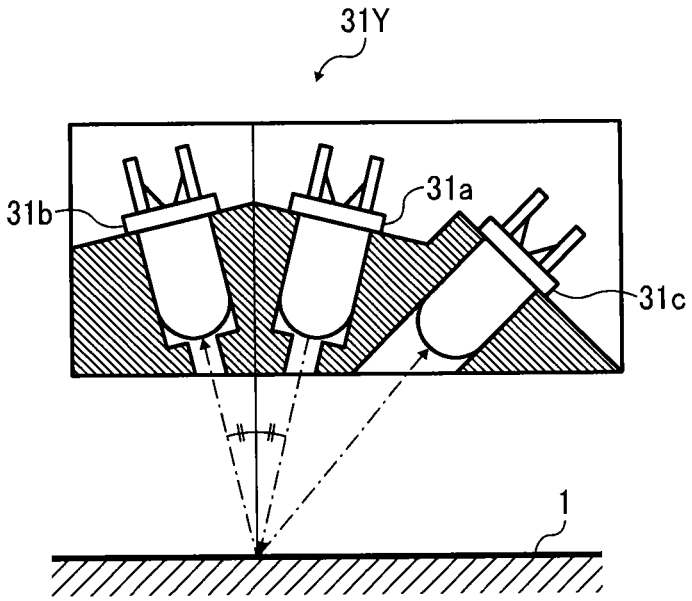
FIG. 6 is a schematic diagram of a sensor head for color other than black of the image density sensor illustrated in FIG. 4.

FIG. 6 is a schematic diagram illustrating a configuration of the sensor head 31Y as a representative of the sensor heads 31Y, 31M, and 31C for colors other than black.

As illustrated in FIG. 6, the sensor head 31Y includes the light-emitting element 31*a*, which is, for example, a light emitting diode (LED), the light-receiving element 31*b* to receive specular reflection of light, and another light-receiving element 31*c* to receive diffuse reflection of light. The light-emitting element 31*a* directs light to the surface of the intermediate transfer belt 1. The light is reflected from the intermediate transfer belt 1, and the light-receiving element 31*b* receives specular reflection of the light-receiving element 31*b*. The light-receiving element 31*c* receives diffuse reflection of the light.

In the present embodiment, as the light-emitting element 31*a*, a gallium arsenide (GaAs) infrared LED to emit light whose peak wave length is about 950 nm is used. As the light-receiving elements 31*b* and 31*c*, for example, silicon (Si) phototransistors of peak light receiving sensitivity of about 800 nm are used. It is to be noted that the peak wave length and the peak light receiving sensitivity are not limited thereto.

Each sensor head 31 faces the outer circumferential face of the intermediate transfer belt 1 across a distance of about 5 mm as a detection distance. In the present embodiment, the image density sensor 30 is positioned adjacent to the intermediate transfer belt 1 to detect the adjustment toner patterns on the intermediate transfer belt 1 to adjust the image forming conditions based on the image density of the adjustment toner patterns and determine the image formation timing based on the positions of the adjustment toner patterns on the intermediate transfer belt 1. However, in another embodiment, the image density sensor 30 is disposed to face the photoconductor drum 2. In yet another embodiment, the image density sensor 30 is disposed to face the secondary transfer belt 16.

The controller 37 converts a signal output from the image density sensor 30 into the toner adhesion amount according to a conversion algorithm and stores the toner adhesion amount as an image density in the nonvolatile memory or the volatile memory of the controller 37. In this regard, the controller 37 and the image density sensor 30 in combination serve as an image density detector. The controller 37 stores the image density as time series data at predetermined sampling intervals. Known algorithms are usable for the conversion algorithm to convert the toner adhesion amount. The nonvolatile memory or the volatile memory of the controller 37 various data such as sensor outputs, for example, from the surface potential sensors 19, data for adjustment, results of adjustment and control as well.

Figure 7A:
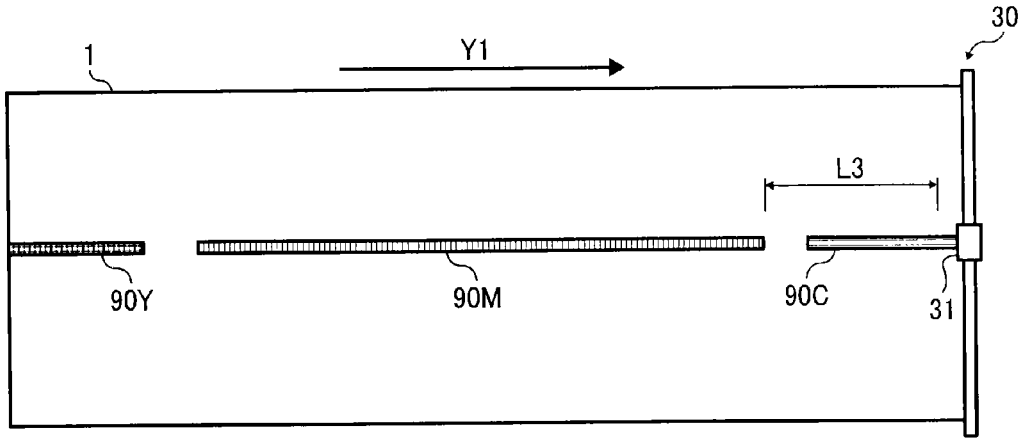
FIG. 7A illustrates an arrangement of respective color adjustment toner patterns according to an embodiment, in which the toner patterns are disposed at an identical position in a main scanning direction on an intermediate transfer belt.
Figure 7B:
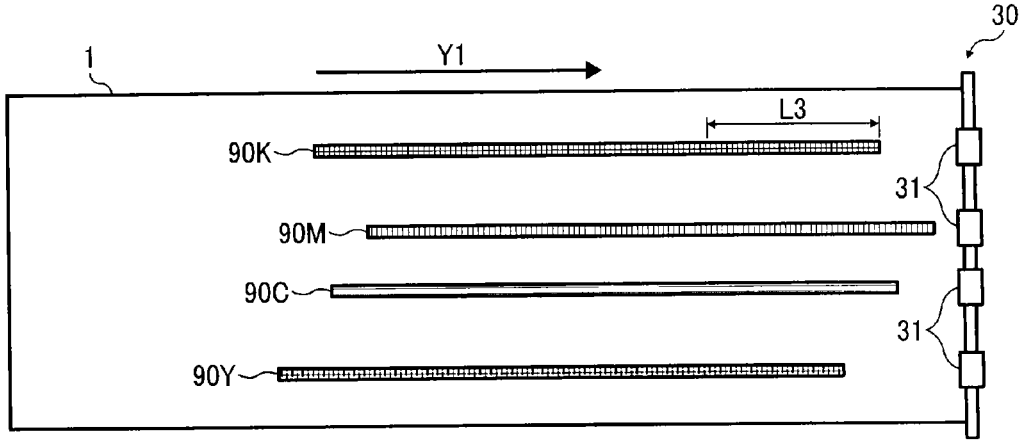
FIG. 7B illustrates another arrangement of the respective color adjustment toner patterns, in which the toner patterns are disposed at different positions in the main scanning direction on the intermediate transfer belt.

In FIGS. 7A and 7B, reference characters 90Y, 90M, 90C, and 90K represent the adjustment toner patterns (hereinafter also collectively "adjustment toner patterns 90"). As illustrated in FIGS. 7A and 7B, the adjustment toner patterns 90 are designed to have an image density within a predetermined range, for example, from about 15% to about 100%. In the configuration illustrated in FIGS. 7A and 7B, the adjustment toner patterns 90 are designed as solid images having an image density of 100%.

The adjustment toner pattern 90 of each of the four colors is long in the travel direction Y1 of the intermediate transfer belt 1 (the sub-scanning direction) and shaped like a ribbon. The adjustment toner pattern 90 has a length in the sub-scanning direction equal to or longer than a circumferential length (in the direction or arc) of a rotator (in the present embodiment, the photoconductor drum 2 or the developing roller 5*a*) whose rotation cycle is equal to or an integral multiple of the cycle of uneven image density. In the present embodiment, the length of the adjustment toner pattern 90 in the sub-scanning direction is equivalent to a triple of the circumferential length of the photoconductor drum 2.

The adjustment operation according to the present embodiment is to suppress uneven image density caused by cyclic fluctuations in size of the development gap G (in FIG. 3) between the photoconductor drum 2 and the developing roller 5*a*. Specifically, the development gap G fluctuates due to, for example, runout in rotation of the photoconductor drum 2. One cause of the runout is eccentricity of the center of rotation of the photoconductor drum 2. Accordingly, the uneven image density caused by fluctuations in the development gap G includes an unevenness component having the rotation cycle of the photoconductor drum 2. Here, the rotation cycle of the photoconductor drum 2 includes a division (quotient) of the rotation cycle divided by a given integral. To detect the density unevenness component, the length in the sub-scanning direction of the adjustment toner pattern 90 is equal to or longer than the circumferential length of the photoconductor drum 2.

In the arrangement illustrated in FIG. 7A, the adjustment toner patterns 90 for the respective colors are disposed at an identical or similar position in the main scanning direction. This position corresponds to a detection area of the image density sensor 30 in the main scanning direction, in particular, the position where the sensor heads 31 are situated. It is to be noted that, although the position of the adjustment toner patterns 90 in the main scanning direction coincides with the center portion of the intermediate transfer belt 1 in that direction in FIG. 7A, the position is not limited thereto. For example, in another embodiment, the adjustment toner patterns 90 are positioned adjacent to an end of the intermediate transfer belt 1 in the main scanning direction.

By contrast, in the arrangement illustrated in FIG. 7B, the adjustment toner patterns 90 for the respective colors are disposed at different positions in the main scanning direction. These positions respectively correspond to detection areas of the image density sensor 30 in the main scanning direction, in particular, the positions where the sensor heads 31 are situated.

The arrangement of the adjustment toner patterns 90 illustrated in FIG. 7A is advantageous in that the image densities of the toner patterns are detectable with a single sensor head 31. By contrast, the arrangement of the adjustment toner patterns 90 illustrated in FIG. 7B is advantageous in that the image densities of the toner patterns are concurrently detectable, and time period for detection of respective color adjustment toner patterns 90 is shortened.

The image forming conditions in formation of the adjustment toner patterns 90 are kept constant. For example, the image forming conditions include a charging condition of the charging rollers 3, an exposure condition (writing condition) of the optical writing unit 4, a developing condition of the developing devices 5, and a transfer condition of the primary transfer rollers 6. For example, in the present embodiment, the charging condition is the charging bias, the writing condition is the intensity of writing light, the developing condition is the developing bias, and the transfer condition is the transfer bias. It is to be noted that, operations of the charging rollers 3, the optical writing unit 4, the developing devices 5, the primary transfer rollers 6, and the like in formation of the adjustment toner patterns 90 are similar to those in standard image formation to form images according to image data.

In a state in which there are no causes of uneven image density, such as fluctuations in the development gap G and uneven sensitivity of the photoconductor drum 2, when the adjustment toner patterns 90 are formed with the image forming conditions kept constant to attain uniform image density, the adjustment toner patterns 90 are uniform in image density in the sub-scanning direction. In other words, even keeping the image forming conditions constant to form adjustment toner patterns 90 to attain uniform image density thereof, the image density is made uneven by the causes of uneven image density such as fluctuations in the development gap G. Data of uneven image density is acquired by consecutively detecting the image density of the adjustment toner patterns 90 that are long in the sub-scanning direction using the image density sensor 30. Specifically, signals output from the image density sensor 30 are input as time series data to the controller 37 at predetermined sampling intervals. Then, the controller 37 stores the time series data as time series image density with reference to the home positions of the photoconductor drums 2 according to rotation position detection signals SG1 (see FIG. 8) output from the photointerrupters 18Y, 18C, 18M, and 18K (hereinafter collectively "photointerrupters 18").

Figure 8:
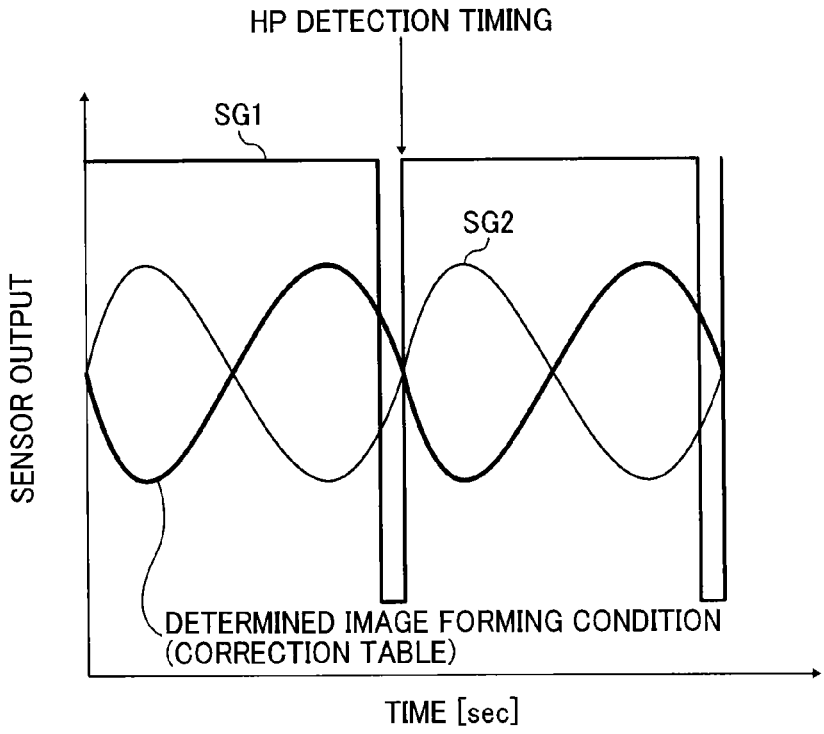
FIG. 8 is a graph of relations among a rotation position detection signal output from a photointerrupter, a toner amount detection signal (for one rotation cycle of a photoconductor drum) output from an image density sensor, and a correction table generated according to these signals.

FIG. 8 is a graph of relations among the rotation position detection signal SG1 output from the photointerrupter 18, a toner amount detection signal SG2 (for one rotation cycle of the photoconductor drum 2) output from the image density sensor 30, and a correction table (i.e., correction data) generated according to these signals. It is to be noted that signals for the duration equivalent to two rotation cycles of the photoconductor drum 2 are illustrated in FIG. 8.

In FIG. 8, the detected uneven image density of the adjustment toner pattern 90 is expressed as fluctuations in the adhesion amount detection signal SG2. As illustrated in FIG. 8, the adhesion amount detection signal SG2 fluctuates in the cycle identical or similar to the cycle of the rotation position detection signal SG1. In the present embodiment, a correction table is established to cancel the detected image density unevenness by adjusting the settings of the image forming conditions, such as settings of the developing devices 5 and the charging rollers 3, to cause image density unevenness in a phase opposite that of the detected image density unevenness.

It is to be noted that, in some cases, the term "opposite phase" is not precise since it is possible that the developing bias, the exposure power, and the charging bias, which are the image forming conditions, are negative in polarity, or the toner adhesion amount decreases as the absolute value thereof increases. However, the term "opposite phase" is used to mean that the correction table established here is in the direction to cancel the image density unevenness indicated by the adhesion amount detection signal SG2, that is, the correction table is to generate image density unevenness opposite in phase to the image density unevenness indicated by the adhesion amount detection signal SG2.

In principle, a gain in generating the correction table, that is, the amount of changes of the correction table relative to the amount of changes (V) of the adhesion amount detection signal SG2, is determined according to theoretical values. In practice, however, the gain is preferably determined according to data obtained through an experiment to verify the theoretical values in a commercial apparatuses. In generating the correction table to cause the opposite phase uneven image density from the adhesion amount detection signal SG2 using the gain thus determined, the rotation position detection signal SG1 from the photointerrupter 18 is used as a reference to attain the timings illustrated in FIG. 8, for example. In the example illustrated in FIG. 8, a leading end of the correction table coincides with the home position (HP) detection timing of the photoconductor drum 2, that is, a rising timing of the rotation position detection signal SG1 output from the photointerrupters 18.

When such a correction table is generated for adjusting, for example, the developing bias, a travel time of the adjustment toner pattern 90 from the developing range to the image density sensor 30 is taken into account. In a case where the travel time is an integral multiple of the rotation cycle of the photoconductor drum 2, the leading end of the correction table is aligned with the timing of the rotation position detection signal SG1. Further, in the adjustment operation, data is retrieved from the leading end of the correction table at the timing of the rotation position detection signal SG1, that is, the HP detection timing, and adjustment of the developing bias is started. Thus, the uneven image density is canceled as illustrated in FIG. 8.

In a case where the travel time of the adjustment toner pattern 90 deviates from an integral multiple of the rotation cycle of the photoconductor drum 2, the correction table is shifted by a length of time equivalent to the deviation from the integral multiple. Specifically, in generating the correction table, the timing to start acquisition of the signal from the image density sensor 30 (acquisition timing of leading end data of the correction table) is shifted by that amount from the timing of the rotation position detection signal SG1 (HP detection timing). In this case, in the adjustment operation, at the HP detection timing, data is retrieved from the leading end of the correction table, and adjustment of the developing bias is started. Then, the uneven image density can be canceled as illustrated in FIG. 8.

In particular, as described above, the intermediate transfer belt 1 is different in linear velocity from the photoconductor drums 2 in image formation in the present embodiment. In a case where the intermediate transfer belt 1 is different in linear velocity from the photoconductor drums 2 also in formation of the adjustment toner patterns 90, even if the travel distance (hereinafter also "distance L") for the adjustment toner pattern 90 to move from the developing range to the image density sensor 30 is equivalent to an integral multiple of the circumferential length of the photoconductor drum 2, the travel time of the adjustment toner pattern 90 is not an integral multiple of the rotation cycle of the photoconductor drum 2. This is because the speed at which the adjustment toner pattern 90 moves from the primary transfer nip to the image density sensor 30 is identical to the linear velocity of the intermediate transfer belt 1, but the linear velocity of the intermediate transfer belt 1 differs from that of the photoconductor drum 2.

Therefore, in the present embodiment, considering that the travel time for the adjustment toner pattern 90 to move from the developing range to the image density sensor 30 deviates from an integral multiple of the rotation cycle of the photoconductor drum 2 due to the linear velocity difference between the intermediate transfer belt 1 and the photoconductor drum 2, the start of adjustment of the image forming condition (e.g., the developing bias) is shifted by the deviation time.

Figure 9:
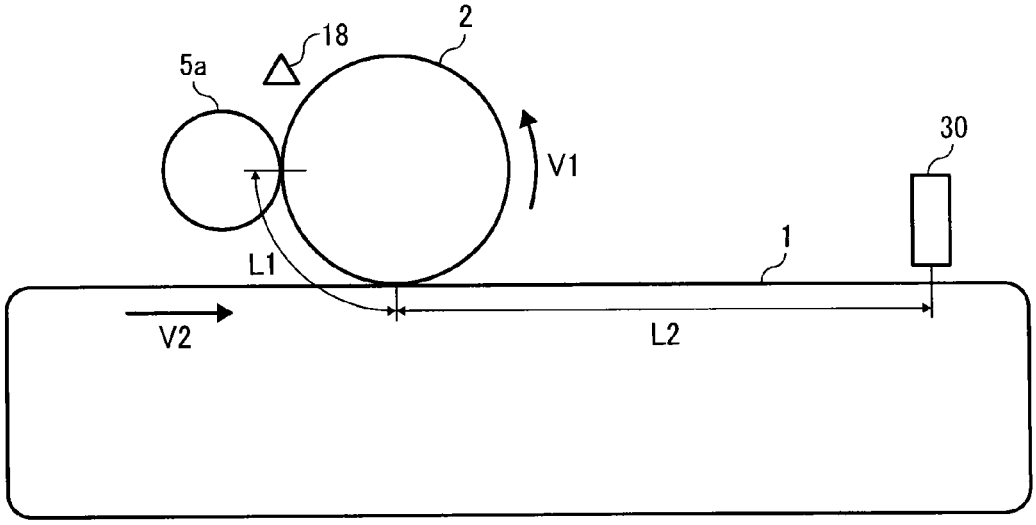
FIG. 9 is a schematic diagram that illustrates a distance from a developing range to the image density sensor.

Referring to FIG. 9, the distance L from the developing range to the image density sensor 30 is described below.

In FIG. 9, reference character "L1" represents the length of the photoconductor drum 2 in the direction of rotation thereof from the developing range, where the photoconductor drum 2 faces the developing roller 5*a*, to the primary transfer nip, where the photoconductor drum 2 contacts the intermediate transfer belt 1. Further, reference character "L2" represents the length of the intermediate transfer belt 1 in the travel direction thereof from the primary transfer nip to the detection position of the image density sensor 30. At that time, the distance L from the developing range to the detection position of the image density sensor 30 is expressed as L=L1+L2.

Next, descriptions are given below of timing to start development of the leading end of the adjustment toner pattern 90 in adjustment of uneven image density.

As illustrated in FIG. 9, the image forming apparatus 100 includes the photointerrupter 18 to detect whether or not the photoconductor drum 2 is at the predetermined home position in the direction of rotation thereof. The image forming apparatus 100 further includes a photointerrupter 71 (illustrated in FIG. 13) described later, to detect a home position of the developing roller 5*a*. The photointerrupter 18, as well as the photointerrupter 71, detects the home position of the rotator (the photoconductor drum 2 or the developing roller 5*a*) by optically detecting a shield that rotates as the rotation shaft of the rotator rotates. Here, reference character "L3" is given to the circumferential length of the photoconductor drum 2. In the present embodiment, when the distance L is an integral multiple of the circumferential length L3 of the photoconductor drum 2, the start timing of development of the leading end of the adjustment toner pattern 90 is adjusted to the HP detection timing, at which the photoconductor drum 2 is positioned at the home position.

For example, in a case where the length L is a triple of the circumferential length L3 of the photoconductor drum 2 (L=3×L3) and the photoconductor drum 2 is identical in linear velocity with the intermediate transfer belt 1, after development of the adjustment toner pattern 90 is started at the timing of the home position, the leading end of the adjustment toner pattern 90 reaches the position of the image density sensor 30 at third detection of the home position. With this configuration, the correction table having a proper adjustment timing is generated by cutting out the waveform of the adhesion amount detection signal SG2, output from the image density sensor 30, with reference to the HP detection timing (i.e., HP reference waveform), that is, by starting acquisition of the output from the image density sensor 30 with reference to the HP detection timing.

By contrast, when the distance L is not an integral multiple of the circumferential length L3 of the photoconductor drum 2, for example, the start timing of development of the leading end of the adjustment toner pattern 90 is shifted from the HP detection timing. Here, the reference character "V1" is given to the linear velocity of the photoconductor drum 2. For example, in the case where L=3×L3+ΔL, development is started after elapse of time (L3−ΔL)/V1 from the timing of the home position. In this case, similarly, when the photoconductor drum 2 is identical in linear velocity with the intermediate transfer belt 1, after development of the adjustment toner pattern 90 is started, the leading end of the adjustment toner pattern 90 reaches the position of the image density sensor 30 at fourth detection of the home position. With this configuration, the correction table having a proper adjustment timing is generated by cutting out the waveform of the adhesion amount detection signal SG2, output from the image density sensor 30, with reference to the HP detection timing.

It is to be noted that, in the case where the linear velocity of the intermediate transfer belt 1 (hereinafter "linear velocity V2") differs from that of the photoconductor drum 2, the travel speed of the adjustment toner pattern 90 from the primary transfer nip to the image density sensor 30 is identical to the linear velocity V2 of the intermediate transfer belt 1 and different from the linear velocity V1 of the photoconductor drum 2. The adjustment operation described above is on the assumption that the leading end of the adjustment toner pattern 90 reaches the position of the image density sensor 30 at the detection timing of the home position. In other words, the time point at which the leading end of the adjustment toner pattern 90 reaches the position of the image density sensor 30 is estimated based on the linear velocity V1 of the photoconductor drum 2, that is, the process linear velocity. Therefore, an actual time point at which the leading end of the adjustment toner pattern 90 reaches the position of the image density sensor 30 differs from the estimated timing based on the linear velocity V1 of the photoconductor drum 2 (HP detection timing).

Figure 10:
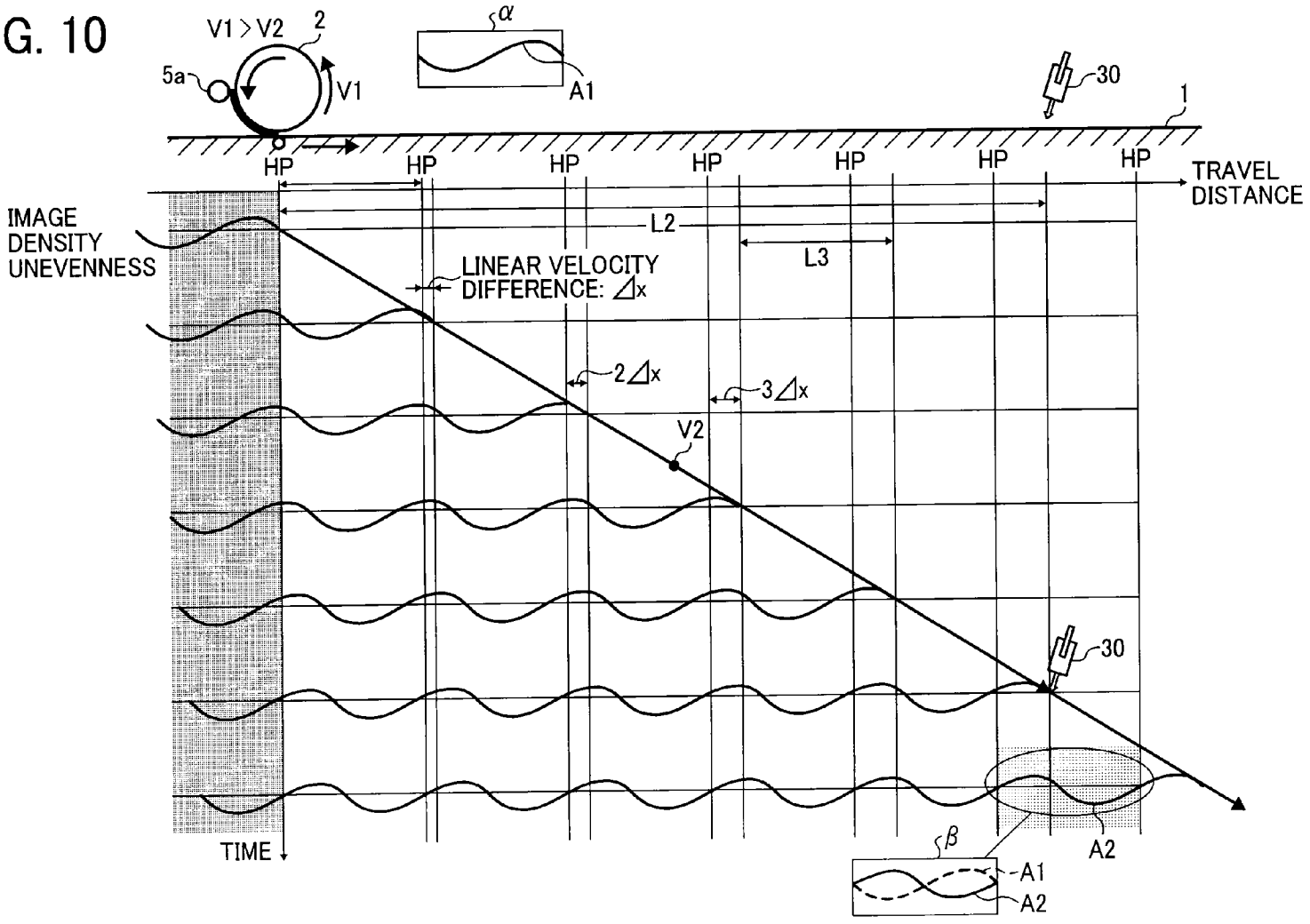
FIG. 10 is a schematic diagram of a relation between a leading end position of the adjustment toner pattern on the intermediate transfer belt and the uneven image density waveform when the photoconductor drum is higher in linear velocity than the intermediate transfer belt.

Referring to FIG. 10, descriptions are given below of the relation between the leading end position of the adjustment toner pattern 90 on the intermediate transfer belt 1 and the uneven image density waveform when the linear velocity V1 of the photoconductor drum 2 is higher than the linear velocity V2 of the intermediate transfer belt 1 (V1>V2).

In the case illustrated in FIG. 10, the image density sensor 30 is situated at a distance of five times as long as the length L2 on the intermediate transfer belt 1 from the primary transfer nip to the detection position of the image density sensor 30. Additionally, in the example illustrated in FIG. 10, the leading end of the adjustment toner pattern 90 passes through the primary transfer nip at the HP detection timing. In the graph illustrated in FIG. 10, the time axis progresses downward. As the time elapses, the travel distance of the adjustment toner pattern 90 increases (rightward in FIG. 10). A hatched portion on the left in FIG. 10 represents the waveform of uneven image density on the photoconductor drum 2, and a portion extending to the right from the hatched portion represents the waveform of uneven image density on the intermediate transfer belt 1. An original waveform with reference to the HP detection timing (hereinafter "HP reference waveform A1") is cut out in a portion α in FIG. 10. In a portion β in FIG. 10, the HP reference waveform A1 is overlapped with a waveform A2 of the toner amount detection signal SG2 output from the image density sensor 30. Additionally, the image density sensor 30 cuts out the waveform with reference to the HP detection timing.

When the linear velocity V1 of the photoconductor drum 2 is higher than the linear velocity V2 of the intermediate transfer belt 1 (V1>V2), as illustrated in FIG. 10, for each rotation of the photoconductor drum 2, the actual position of the leading end of the adjustment toner pattern 90 is deviated from the position at the HP detection timing (estimated position with reference to the linear velocity V1 of the photoconductor drum 2) by a linear velocity difference Δx between the photoconductor drum 2 and the intermediate transfer belt 1. Then, the time point at which the leading end of the adjustment toner pattern 90 reaches the position of the image density sensor 30 is deviated from the detection timing of the home position by a deviation amount expressed as (L2/L3)× L3/(V1−V2)=L2/(V1−V2). This deviation (deviation in time) increases as the length L2 from the primary transfer nip to the detection position of the image density sensor 30 increases.

In view of the foregoing, in the correction table according to the present embodiment, the deviation L2/(V1−V2) is considered. Specifically, the timing to start acquisition of the signal from the image density sensor 30 (acquisition timing of leading end data of the correction table) is shifted by the deviation L2/(V1−V2) from the timing of the rotation position detection signal SG1 (HP detection timing).

Specifically, deviation time data is preliminarily stored in the nonvolatile memory or the volatile memory of the controller 37. Then, in generating the correction table, the controller 37 retrieves the deviation time data.

Here, "reference arrival time" means an arrival time of the leading end of the adjustment toner pattern 90 at the position detected by the image density sensor 30, estimated based on the linear velocity of the photoconductor drum 2. That is, the reference arrival time means an estimated time point at which the leading end of the adjustment toner pattern 90 would arrive at the detection position of the image density sensor 30 if the photoconductor drum 2 is identical in linear velocity to the intermediate transfer belt 1.

Then, the controller 37 starts acquisition of the signal output from the image density sensor 30 at a time point shifted, by an amount indicated by the deviation time data, from the HP detection timing that coincides with the reference arrival time.

As another example, the following operation may be performed, for example, when the length L2 of the intermediate transfer belt 1 in the travel direction from the primary transfer nip to the detection position of the image density sensor 30, the linear velocity V1 of the photoconductor drum 2, and the linear velocity V2 of the intermediate transfer belt 1 are preliminarily stored in the memory. That is, in generating the correction table, the controller 37 retrieves the preliminarily stored data and calculates L2/(V1−V2) based on the retrieved data. When there is no linear velocity difference between the photoconductor drum 2 and the intermediate transfer belt 1, the controller 37 starts acquisition of the signal output from the image density sensor 30 at a time point shifted, by the deviation L2/(V1−V2), from the HP detection timing that coincides with the reference arrival time of the leading end of the adjustment toner pattern 90 at the detection position of the image density sensor 30.

This adjustment eliminates the deviation in phase between the HP reference waveform A1 (original waveform) and the waveform A2 of the toner amount detection signal SG2 output from the image density sensor 30. Then, the correction table does not have deviations in adjustment timing. In this case, the uneven image density can be canceled as illustrated in FIG. 8 by retrieving data from the leading end of the correction table at the time point at which the leading end of the adjustment toner pattern 90 passes through the developing range (determined with reference to the HP detection timing) and starting adjustment of the developing bias in the adjustment operation.

It is to be noted that, although the description above concerns generation of the correction table in which the timing is preliminarily shifted by L2/(V1−V2), in another embodiment, the correction table is generated as is, and the start of retrieval of the correction table is shifted by the time equivalent to L2/(V1−V2) in the adjustment operation. Specifically, in generating the correction table, the timing to start acquisition of the signal output from the image density sensor 30 is made identical to the HP detection timing. Subsequently, in the adjustment operation, data is retrieved from the leading end of the correction table at the timing shifted by that amount from when the leading end of the adjustment toner pattern 90 passes through the developing range (determined with reference to the HP detection timing) and adjustment of the developing bias is started. In this case, the uneven image density is canceled similar to the case illustrated in FIG. 8.

As a specific example, the deviation time data is preliminarily stored in the nonvolatile memory or the volatile memory of the controller 37. In executing the adjustment operation, the controller 37 retrieves the deviation time data, and, at the timing shifted by the amount indicated by the deviation time data from the timing (at which the leading end of the adjustment toner pattern 90 passes through the developing range) subsequent to elapse of a predetermined time with respect to the HP detection timing, the data is retrieved from the leading end of the correction table and adjustment of the developing bias is started.

As another example, the following operation may be performed, for example, when the length L2 of the intermediate transfer belt 1 in the travel direction from the primary transfer nip to the detection position of the image density sensor 30, the linear velocity V1 of the photoconductor drum 2, the linear velocity V2 of the intermediate transfer belt 1 are preliminarily stored in the memory. That is, in generating the correction table, the controller 37 retrieves the preliminarily stored data and calculates L2/(V1−V2) based on the retrieved data. Then, the controller 37 retrieves the data from the leading end of the correction table and starts adjusting the developing bias at the timing shifted from the elapse of a predetermined time from the HP detection timing (the passing of the leading end of the adjustment toner pattern 90 through the developing range) by the time deviation from the timing estimated based on L2/(V1−V2), at which the leading end of the adjustment toner pattern 90 passes through the developing range.

Similarly, when the correction table is to adjust the exposure power, the travel time for the adjustment toner pattern 90 to move from an exposure position to the image density sensor 30 is considered in using the correction table. Similarly, when the correction table is to adjust the charging bias, the travel time for the adjustment toner pattern 90 to move from a charging position to the image density sensor 30 is considered in using the correction table. In those cases, the correction table is generated considering the deviation L2/(V1−V2).

It is to be noted that, in practice, it is possible that deviation in phase is caused by delay in response of the power supply 33 (i.e., a high-pressure power source), variations in component accuracy, distances between components due to variations in assembling accuracy, or the like. Accordingly, to generate the correction table, it is preferred to experimentally verify the theoretical values in a commercial apparatuses and adjust the deviation in phase based on data obtained through the experiment.

The start of formation of the adjustment toner patterns 90 is determined according to the detection timings of the photointerrupters 18Y, 18M, 18C, and 18K detecting the home positions of the photoconductor drums 2Y, 2M, 2C, and 2K. In the configuration illustrated in FIG. 8, the adjustment toner patterns 90 are formed in synchronization with the HP detection timing so that the image density sensor 30 detects the leading end of the adjustment toner pattern 90 at the HP position detection timing (the rising timing of the rotation position detection signal SG1).

Figure 11:
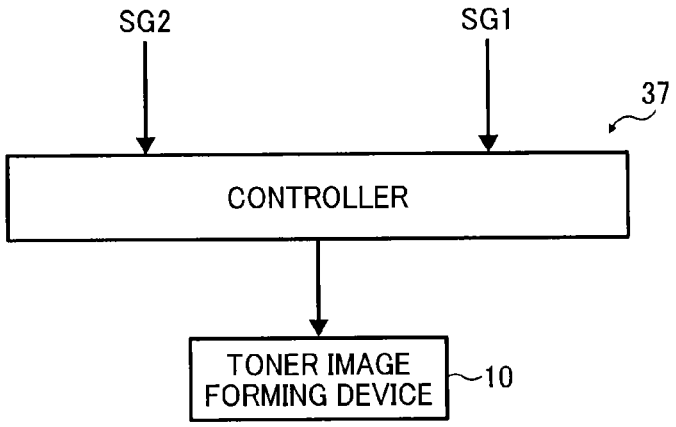
FIG. 11 is a block diagram of data input to and output from a controller according to an embodiment.

The rotation position detection signals SG1 from the photointerrupters 18Y, 18M, 18C, and 18K are input to the controller 37 so that the adjustment toner pattern 90 are formed at that timing as illustrated in FIG. 11. The controller 37 acquires the HP detection timings from the rotation position detection signals SG1 and causes the toner image forming device 10 to form the adjustment toner patterns 90 in synchronization with the acquired timings.

Additionally, as illustrated in FIG. 11, the adhesion amount detection signal SG2 from the image density sensor 30 is input to the controller 37. In generating the correction table, the controller 37 recognizes the HP detection timings from the rotation position detection signals SG1 from the photointerrupters 18Y, 18M, 18C, and 18K and, in synchronization with the acquired timings, starts sampling the adhesion amount detection signal SG2 output from the image density sensor 30.

Figure 12:
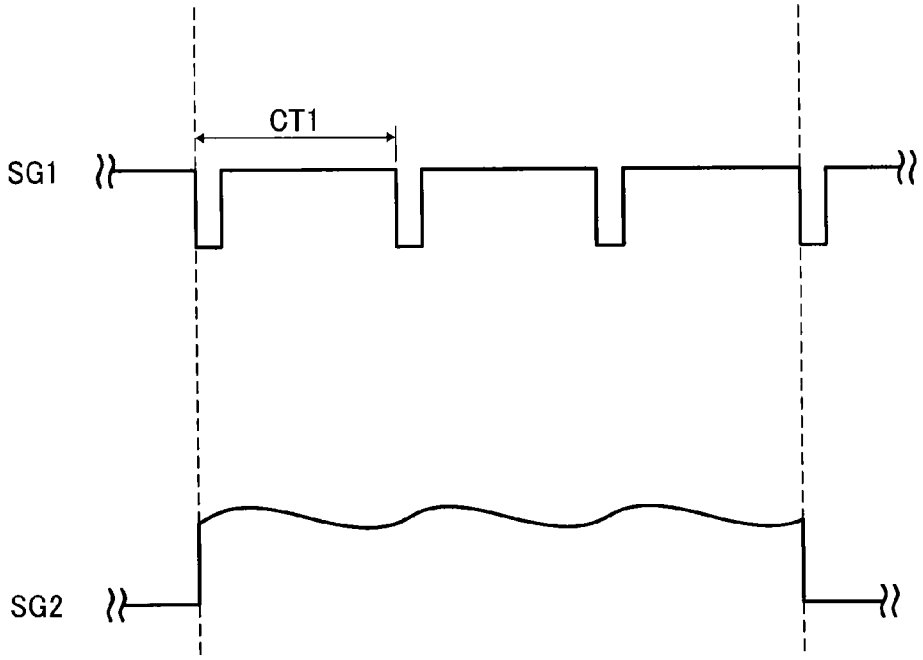
FIG. 12 is a timing chart illustrating the relation between a signal indicating detection of the rotation position of the photoconductor drum and the adhesion amount detection signal output from the image density sensor.

FIG. 12 is a timing chart illustrating the relation between the rotation position detection signal SG1 of the photoconductor drum 2 and the adhesion amount detection signal SG2 from the image density sensor 30. In FIG. 12, reference character CT1 represents one rotation cycle of the photoconductor drum 2.

In the present embodiment, to attain the opposite phase relation illustrated in FIG. 8, an exposure start position of the adjustment toner pattern 90 is synchronized with the HP detection timing so that the image density sensor 30 detects the leading end of the adjustment toner pattern 90 at the HP position detection timing (the rising timing of the rotation position detection signal SG1). In the present embodiment, although sampling of the adhesion amount detection signal SG2 from the image density sensor 30 is started at the leading end of the adjustment toner pattern 90, the amount of toner adhering to the leading end (or adjacent thereto) of the adjustment toner pattern 90 tends to be unstable. Therefore, alternatively, the positions at which the optical writing units 4Y, 4M, 4C, and 4K start exposure for the adjustment toner patterns 90 may be determined so that sampling of the adhesion amount detection signal SG2 from the image density sensor 30 is started not at the leading end of the adjustment toner pattern 90 but at a position shifted therefrom to a trailing side, to a position where the toner adhesion amount is stable.

The exposure start position of the adjustment toner patterns 90 is determined using the HP detection timings of the photoconductor drums 2Y, 2M, 2C, and 2K, detected by the photointerrupters 18Y, 18M, 18C, and 18K, and the travel times for the adjustment toner patterns 90 to move from the exposure positions of the optical writing units 4Y, 4M, 4C, and 4K to the detection position by the image density sensor 30. The HP detection timings and the travel times of the adjustment toner patterns 90 are stored in the nonvolatile memory or the volatile memory of the controller 37. For example, the travel times for the adjustment toner patterns 90 to move from the exposure positions of the optical writing units 4Y, 4M, 4C, and 4K to the detection position by the image density sensor 30 are calculated from the distance (in layout) between the exposure position of the optical writing units 4Y, 4M, 4C, and 4K to the detection position of the image density sensor 30, the process linear velocity (linear velocity of the photoconductor drums 2), and the linear velocity difference between the photoconductor drums 2 and the intermediate transfer belt 1.

The trailing end position of the adjustment toner pattern 90 may be determined similar to the leading end position determined as described above. Alternatively, even when the leading end position is determined freely, the trailing end position may be determined according to the above-mentioned data. In another embodiment, the leading end position, the trailing end position, or both, of the adjustment toner pattern 90 according to the above-mentioned data is determined based on the elapsed time from the detection of the home positions of the photoconductor drums 2Y, 2M, 2C, and 2K made by the photointerrupters 18Y, 18M, 18C, and 18K. In this case, the leading end position, the trailing end position, or both, of the adjustment toner pattern 90 are materially determined based on the above-mentioned data. Further, writing of the adjustment toner pattern 90 may be started freely, and the position at which exposure ends may be set to an integral multiple of the circumferential length of the photoconductor drum 2. For example, the CPU of the controller 37 measures the elapsed time. Then, the controller 37 functions as an elapsed time counter.

Controlling the timing of formation of the adjustment toner pattern 90 can obviate the necessity of use of long adjustment toner patterns, thus improving toner yield and shortening the adjustment operation time. It is to be noted that the travel time for the adjustment toner pattern 90 to move to the detection position of the image density sensor 30 is different for each color, and the exposure start position therefor is adjusted for each image forming station. However, the positions of the respective color adjustment toner patterns 90 may be different in the sub-scanning direction, as illustrated in FIG. 7B.

It is to be noted that the development gap can fluctuate due to rotation runout of each of the photoconductor drum 2 and the developing roller 5*a*, both of which are rotators to form the development gap, although the development gap fluctuates due to the rotation runout of the photoconductor drum 2 in the description above. Therefore, in another embodiment, in addition to or instead of the photoconductor drum 2, a reference rotation position (i.e., home position) of the developing roller 5*a* is detected, and a correction table to reduce the density unevenness component having the rotation cycle of the developing roller 5*a* is generated, in synchronization with the home position.

Figure 13:
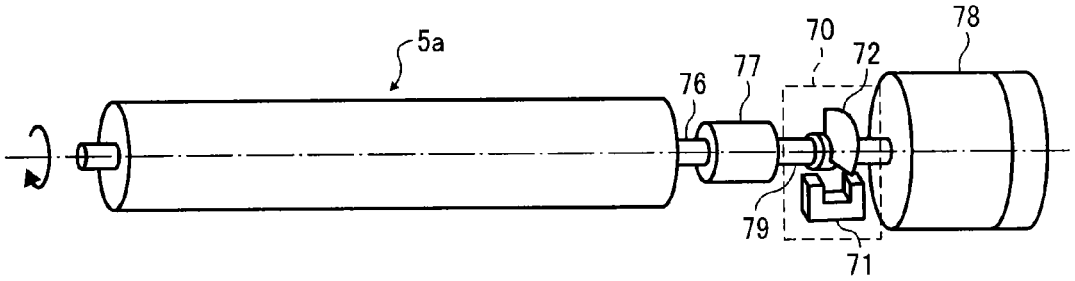
FIG. 13 is a schematic perspective view of a rotation position detector including a photointerrupter to detect a home position of a developing roller according to an embodiment.

FIG. 13 is a schematic perspective view of a rotation position detector 70 including the photointerrupter 71 to detect the home position of the developing roller 5*a*.

Each developing roller 5*a* is provided with one rotation position detector 70, and the rotation position detectors 70 for the respective colors have a similar configuration. As illustrated in FIG. 13, the developing roller 5*a* has a shaft 76, serving as a rotation axis thereof, and the shaft 76 is connected via a coupling 77 to a shaft 79 serving as an output shaft of a driving motor 78. Thus, the developing roller 5*a* is driven by the driving motor 78.

The rotation position detector 70 includes a shield 72 to block light, in addition to the photointerrupter 71. The shield 72 is united with the shaft 79 and rotates as the shaft 79 rotates. When the developing roller 5*a* is at a predetermined rotation position, the shield 72 is detected by the photointerrupter 71. Thus, the photointerrupter 71 detects the home position (reference position in the direction of rotation) of the developing roller 5*a*.

Although the configuration illustrated in FIG. 13 employs a direct-driving method to drive the developing roller 5*a*, in another embodiment, a decelerator is used in drive transmission from the driving motor 78. When the decelerator is used, it is preferred that the shield 72 is on the shaft 76 so that the shield 72 is identical in rotation speed to the developing roller 5*a*, which is similar to detection of the home position of the photoconductor drum 2.

Figure 14:
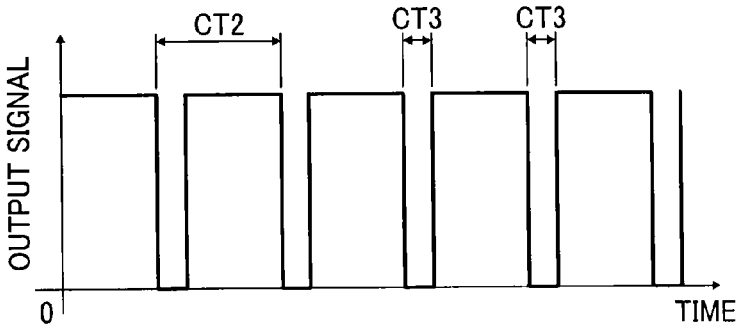
FIG. 14 is a graph of example output from the photointerrupter illustrated in FIG. 13.

FIG. 14 is a graph of example output from the photointerrupter 71.

In FIG. 14, reference character CT2 represents one rotation cycle of the developing roller 5*a*, and CT3 represents a period during which the shield 72 blocks the light from the photointerrupter 71.

According to the graph in FIG. 14, the output from the photointerrupter 71 falls to substantially 0 V (i.e., a falling edge) when the shield 72 blocks the light from the photointerrupter 71. Using the falling edge, the home position of the developing roller 5*a* is detected. To generate the correction table to reduce the density unevenness component having the rotation cycle of the developing roller 5*a*, according to the output (rotation position detection signal SG3) from the photointerrupter 71, the controller 37 samples the adhesion amount detection signal SG2 of the adjustment toner pattern 90, in synchronization with detection of the home position of the developing roller 5*a*.

Figure 15:
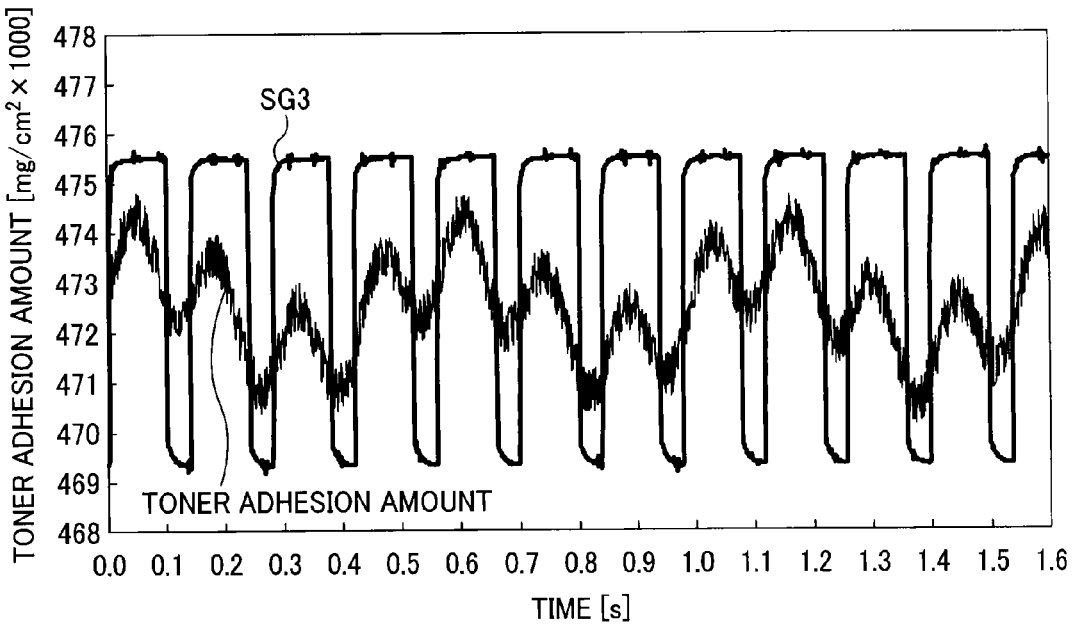
FIG. 15 is a graph illustrating the relation between fluctuations in the toner adhesion amount, indicated by the adhesion amount detection signal output from the image density sensor, and the rotation position detection signal output from the photointerrupter illustrated in FIG. 13.

FIG. 15 is a graph illustrating the relation between fluctuations in the toner adhesion amount, indicated by the adhesion amount detection signal SG2 from the image density sensor 30, and the rotation position detection signal SG3 from the photointerrupter 71.

In the graph in FIG. 15, the abscissa represents time, and the toner adhesion amount ($mg/cm^2 \times 1000$) represented by the ordinate is converted from the adhesion amount detection signal SG2 according to the above-described conversion algorithm. From the graph illustrated in FIG. 15, it is known that the adhesion amount detection signal SG2, output from the image density sensor 30 detecting the adjustment toner pattern 90, fluctuates cyclically in conformity with the rotation cycle of the developing roller 5*a*.

As illustrated in FIG. 15, in addition to the rotation cycle component of the developing roller 5*a*, the adhesion amount detection signal SG2 includes the rotation cycle component of the photoconductor drum 2, for example. Therefore, to generate the correction table to alleviate the density unevenness component having the rotation cycle of the developing roller 5*a*, it is necessary to extract the component having the rotation cycle of the developing roller 5*a* from the adhesion amount detection signal SG2 output from the image density sensor 30. It is to be noted that, although not described above, to generate the correction table to alleviate the density unevenness component having the rotation cycle of the photoconductor drum 2, it is necessary to extract the component having the rotation cycle of the photoconductor drum 2 from the adhesion amount detection signal SG2 output from the image density sensor 30.

For example, the component having the rotation cycle of the developing roller 5*a* is extracted from the adhesion amount detection signal SG2 by segmenting the adhesion amount detection signal SG2 with the HP detection timing included in the signal output from the photointerrupter 71, and averaging each of signal segments.

Figure 16:
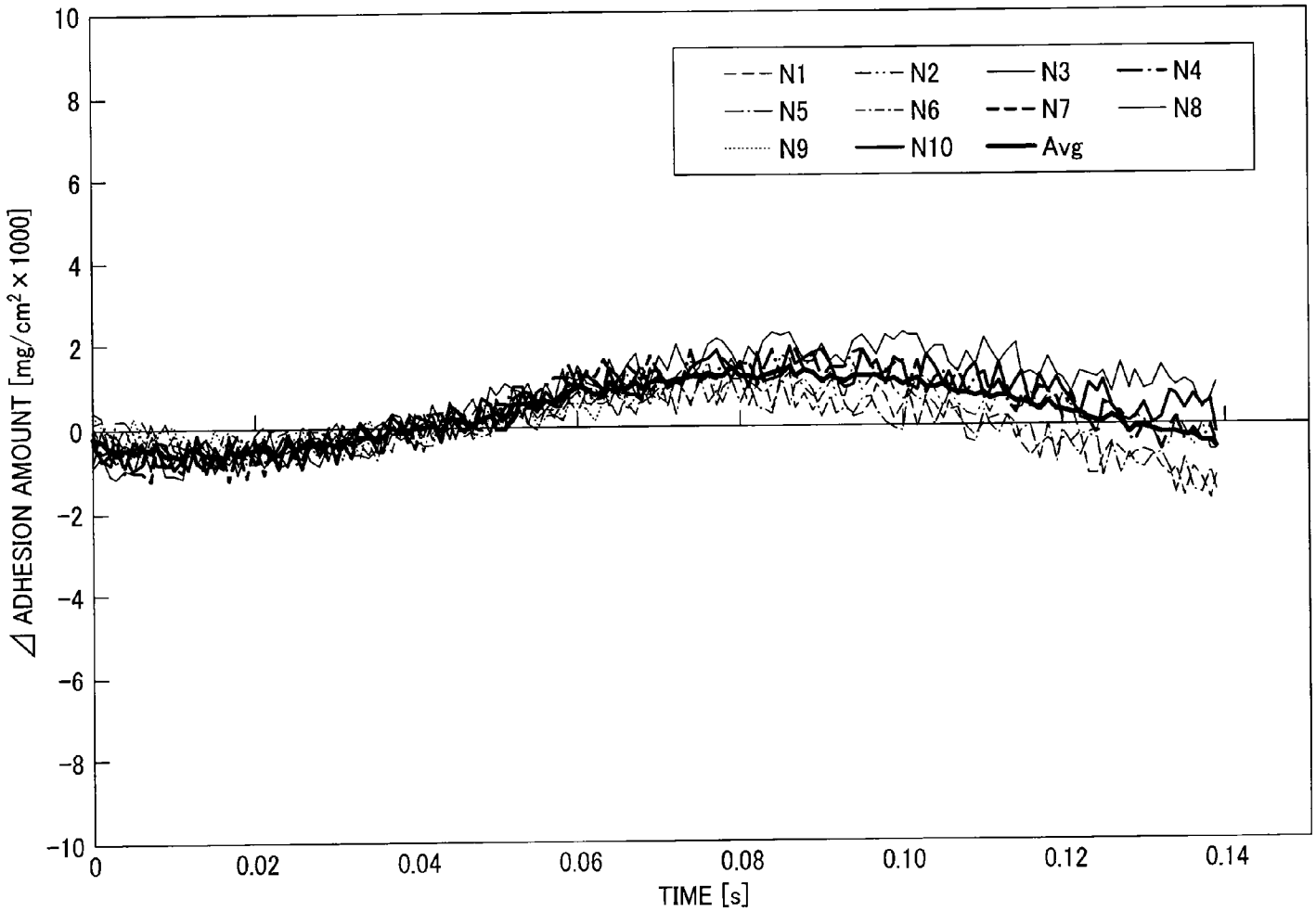
FIG. 16 is a graph of multiple signal segments obtained by segmenting the adhesion amount detection signal with the home position detection timing included in the signal output from the photointerrupter, and the multiple signal segments overlap with each other.

FIG. 16 is a graph of multiple signal segments obtained by segmenting the adhesion amount detection signal SG2 using the HP detection timing included in the signal output from the photointerrupter 71, and the multiple signal segments overlap with each other.

In the present embodiment, ten signal segments N1 through N10 are obtained from the above-described adjustment toner pattern 90 (for three rotation cycles of the photoconductor drum 2). In FIG. 16, a waveform Avg indicated by a bold line represents a result of averaging of those signal segments. Although the description here concerns averaging of ten signal segments, the rotation cycle component of the developing roller 5*a* may be extracted otherwise.

With the signal processing described above, the rotation cycle component of the developing roller 5*a* and the rotation cycle component of the photoconductor drum 2 can be independently acquired from the adhesion amount detection signal SG2 from the image density sensor 30. When these rotation cycle components are obtained from the same adjustment toner pattern 90, the position, length, and the like of the adjustment toner pattern 90 are set according to the circumferential length (the longer of that of the photoconductor drum 2 and that of the developing roller 5*a*), the rotation position, the layout distance, the process linear velocity, and the linear velocity difference between the photoconductor drum 2 and the intermediate transfer belt 1. In the present embodiment, the photoconductor drum 2 is longer in circumferential length.

By contrast, when the density unevenness component having the rotation cycle of the photoconductor drum 2 is not corrected but the density unevenness component having the rotation cycle of the developing roller 5*a* is corrected, the position, length, and the like of the adjustment toner pattern 90 are set according to the circumferential length of the developing roller 5*a*, the rotation position, the layout distance, the process linear velocity, and the linear velocity difference between the photoconductor drum 2 and the intermediate transfer belt 1. The term "layout distance" used here means the distance L (shown in FIG. 9) in the sub-scanning direction from the developing range to the detection position of the adjustment toner pattern 90 by the image density sensor 30.

Additionally, when both of the density unevenness component having the rotation cycle of the photoconductor drum 2 and the density unevenness component having the rotation cycle of the developing roller 5*a* are obtained from the same adjustment toner pattern 90, the start timing of formation of the adjustment toner pattern 90 is determined according to one of the detection timing of the photointerrupter 18 detecting the home positions of the photoconductor drum 2 and the detection timing of the photointerrupter 71 detecting the home positions of the developing roller 5*a*. Accordingly, the home position of one of the photoconductor drum 2 and the developing roller 5*a* is detected for the purpose of determining the timing of formation of the adjustment toner pattern 90, and not both but one of the photointerrupters 18 and 71 is required.

In the controller 37 illustrated in FIG. 11, an image forming condition adjustment program to execute the above described adjustment operation is stored in the nonvolatile memory or the volatile memory. Alternatively, the image forming condition adjustment program may be stored in any other recording media than the nonvolatile memory and the volatile memory. Examples of recording media include a semiconductor sheet such as RAM, and a nonvolatile memory; optical sheet such as a digital versatile disc (DVD), a magnetooptic disc (MO), a magnetic disk (MD), and a compact disc-recordable (CD-R); and a magnetic sheet such as a hard disc, a magnetic tape, and a flexible disc. Such recording media can serve as a computer-readable memory medium storing the image forming condition adjustment program.

Next, descriptions are given below of the relation between fluctuations in the development gap G and the developing electrical field.

Figure 17:
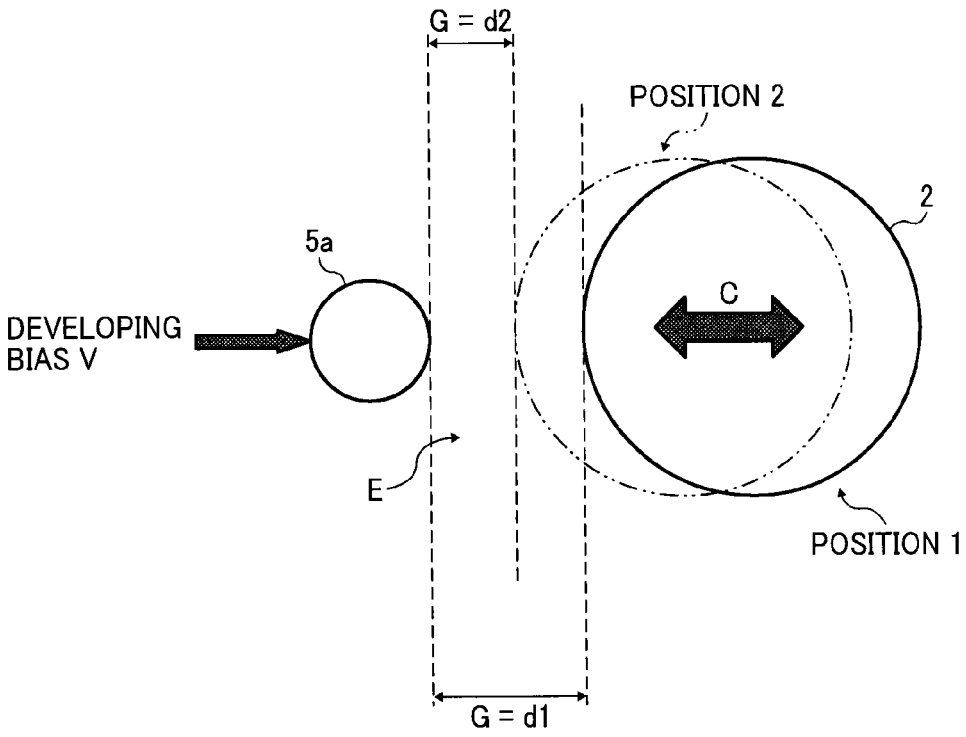
FIG. 17 is a schematic diagram for understanding of fluctuations in the development gap caused by the rotation runout of the photoconductor drum.

FIG. 17 is a schematic diagram for understanding of fluctuations in the development gap caused by the rotation runout of the photoconductor drum 2.

FIG. 17 illustrates the rotation runout of the photoconductor drum 2 between a position 1 (solid line), at which the development gap G has a largest size d1, and a position 2 (broken lines), at which the development gap G has a smallest size d2. IN FIG. 17, reference character "C" represents the runout between the positions 1 and 2. For example, the rotation runout is caused by eccentricity of the photoconductor drum 2. Assuming that a surface potential V of the developing roller 5*a* is kept constant by the developing bias applied to the developing roller 5*a*, a developing electrical field E is smallest when the photoconductor drum 2 is at the position 1. At that time, the image density decreases relatively. By contrast, the developing electrical field E is largest when the photoconductor drum 2 is at the position 2, and the image density at that time increases relatively.

Since the photoconductor drum 2 rotates at constant cycles, in a toner image, a portion having a lower image density alternates with a portion having a higher image density, making the density of the toner image uneven. In the present embodiment, as an example, even when the development gap thus fluctuates, the developing bias is modulated according to the detected uneven image density (the adhesion amount detection signal SG2 regarding the adjustment toner pattern 90) to keep the developing electrical field E stable, thereby alleviating the uneven image density. It is to be noted that uneven image density resulting from the runout of the developing roller 5*a* is similar to that resulting from the runout of the photoconductor drum 2 described above.

The image density becomes uneven due to uneven sensitivity of the photoconductor drum 2 as well as fluctuations in the development gap. When the sensitivity (photosensitive properties) of the photoconductor drum 2 in response to exposure becomes uneven in the sub-scanning direction due to a cause such as degradation with time, a bright area potential, which is the potential of an exposed portion (latent image) of the photoconductor drum 2, differs even when the amount of exposure is identical. Accordingly, a difference is caused between the latent image potential and that of the surface of the developing roller 5*a*. As a result, the toner adhesion amount differs even between portions exposed by an identical exposure amount, and the image density becomes uneven corresponding to the rotation cycle of the photoconductor drum 2. It is to be noted that, although the photoconductor drum 2 may be produced with a higher accuracy to reduce sensitivity variations, the production cost increases.

For example, the image forming conditions to be adjusted to suppress uneven image density are: 1) exposure condition only, 2) transfer condition only, 3) developing condition only, 4) charging condition only, 5) developing condition and exposure condition, 6) developing condition and charging condition, 7) developing condition and charging condition, and 8) developing condition, charging condition, and transfer condition. The condition or conditions adjusted are not limited above, but may be any image forming condition or conditions to control the toner adhesion amount.

[Adjustment Method 1]

Next, descriptions are given below of adjustment of developing bias (hereinafter "adjustment method 1"), as an example of image forming condition adjustment for suppressing uneven image density resulting from the rotation runout of the photoconductor drum 2.

Figure 18:
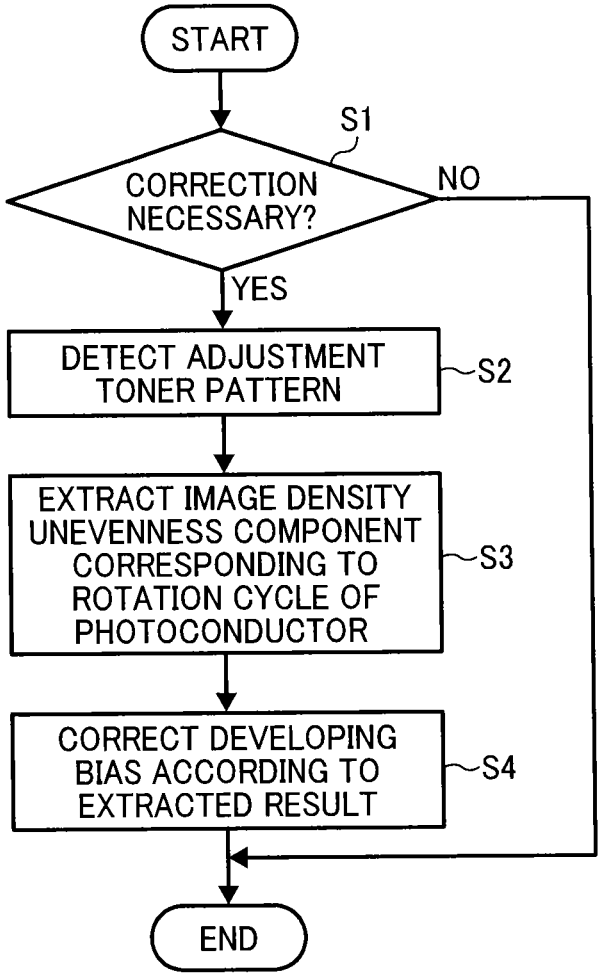
FIG. 18 is a flowchart of an adjustment method according to an embodiment.

FIG. 18 is a flowchart of the adjustment method 1.

In the adjustment method 1, at S1, the controller 37 determines whether the adjustment (i.e., correction) of the image forming condition for suppressing uneven image density is necessary. For example, when the rotation position of the photoconductor drum 2 deviates due to some cause in replacement, the controller 37 determines that the adjustment is necessary. When the controller 37 determines that the adjustment is necessary (Yes at S1), at S2, the controller 37 causes the toner image forming device 10 to form the adjustment toner patterns 90, causes the image density sensor 30 to detect the adjustment toner patterns 90, and recognizes the image density thereof from the output from the image density sensor 30. At that time, each of the photoconductor drums 2, the intermediate transfer belt 1, and the secondary transfer belt 16 is driven at a speed identical or similar to its speed in standard image formation. Accordingly, the adjustment toner patterns 90 are formed and detected by the image density sensor 30 in a state in which the photoconductor drums 2 differ in linear velocity from the intermediate transfer belt 1.

However, the linear velocity difference between the photoconductor drums 2 and the intermediate transfer belt 1 in formation of the adjustment toner patterns 90 is not necessarily the same as that in standard image formation. In the present embodiment, the linear velocity of each of the photoconductor drums 2 and the intermediate transfer belt 1 in formation of the adjustment toner patterns 90 is set to about ±5% of the linear velocity in standard image formation.

Specifically, in standard image formation, the linear velocity of the photoconductor drum 2 is set to 440 mm/s, that of the intermediate transfer belt 1 is set to 400 mm/s, and that of the secondary transfer belt 16 is set to 400 mm/s, for example. By contrast, in formation of the adjustment toner pattern, the linear velocity of the photoconductor drum 2 is set to 439 mm/s, that of the intermediate transfer belt 1 is set to 402 mm/s, and that of the secondary transfer belt 16 is set to 402 mm/s, for example. Thus, in the present embodiment, the linear velocity difference between the photoconductor drums 2 and the intermediate transfer belt 1 in formation of the adjustment toner patterns 90 is not same as that in standard image formation. The inventors have experimentally confirmed that, when the linear velocity of each of the photoconductor drums 2 and the intermediate transfer belt 1 in formation of the adjustment toner patterns 90 is within ±5% of the linear velocity thereof in standard image formation, the difference does not practically matter.

The adhesion amount detection signal SG2 output from the image density sensor 30 is input to the controller 37. The controller 37 segments the adhesion amount detection signal SG2 corresponding to the rotation cycle of the photoconductor drum 2, at the HP timings of the photoconductor drums 2Y, 2M, 2C, and 2K, detected by the photointerrupters 18Y, 18M, 18C, and 18K, and averages the signal in each of signal segments. Thus, the controller 37 extracts the image density unevenness component corresponding to the rotation cycle of the photoconductor drum 2 from the adhesion amount detection signal SG2 at S3.

The data of image density unevenness component for one rotation of the photoconductor drum 2 is stored, as time series data, in a memory 37A (illustrated in FIG. 19B) serving as a density unevenness data memory. According to the time series data indicating the unevenness component, the setting of the developing bias (image forming condition setting) is adjusted to cancel the unevenness component at S4. Specifically, in subsequent image formation, the controller 37 sequentially retrieves the time series data of the density unevenness component from the memory 37A in synchronization to the HP detection timing of the photoconductor drum 2. Then, the controller 37 sequentially calculates a correction amount to adjust the setting of the developing bias to cancel the retrieved density unevenness component. Then, the developing bias adjusted with the calculated correction amount is sequentially applied to the developing roller 5*a*. At that time, the timing of retrieval of the time series data indicating the density unevenness component is controlled considering the linear velocity difference between the photoconductor drum 2 and the intermediate transfer belt 1 so that the deviation in adjustment timing resulting from the linear velocity difference is canceled.

When f1 (t) represents the density unevenness component having the rotation cycle of the photoconductor drum 2, and A represents an adjustment gain, setting ST1 (t) of the developing bias is expressed as Formula 1 below.

$$ST1(t)=A\times f1(t) \qquad \text{Formula 1}$$

It is to be noted that, in the present embodiment, sine curve fitting is used to convert the frequency component extracted from the density unevenness component. That is, in the form of $\Sigma Ai\ \sin(\omega t+\theta i)$, Ai and θi are obtained for each frequency component to an "i" order component. However, the method is not limited thereto, and frequency analysis or polynomial approximation may be used. Additionally, the adjustment gain A varies depending on the image forming conditions (the developability in particular). The memory 37A or the like stores predetermined values in the form of table or the like to obtain a proper correction amount for each developability.

With the adjustment operation described above, fluctuations in the developing electrical field between the photoconductor drum 2 and the developing roller 5*a*, caused by the rotation runout of the photoconductor drum 2, are canceled, thereby suppressing uneven image density.

FIG. 19A is a block diagram illustrating a configuration to execute the adjustment method 1 described above.

In the adjustment operation, the CPU of the controller 37 sequentially retrieves the density unevenness data in time order from the memory 37A and sequentially converts the retrieved data into adjustment data to adjust the setting of the developing bias. The conversion of the density unevenness data is synchronized with the HP detection timing of the photoconductor drum 2, obtained from the rotation position detection signal SG1. The adjusted setting of the developing bias is converted into an analog signal by a digital-to-analog (D/A) converter 37B and input to the power supply 33 to supply the developing bias. The power supply 33 applies a voltage according to the developing bias setting input thereto, thereby canceling the fluctuations in the developing electrical field between the photoconductor drum 2 and the developing roller 5*a*, caused by the rotation runout of the photoconductor drum 2. Then, uneven image density is suppressed.

When the power supply 33 is controlled using pulse-width modulation (PWM), as illustrated in FIG. 19B, the CPU of the controller 37 generates the PWM control signal from the adjustment data and outputs the PWM control signal to the power supply 33 in synchronization with the HP detection timing of the photoconductor drum 2. In this case, similarly, the fluctuations in the developing electrical field between the photoconductor drum 2 and the developing roller 5*a*, caused by the rotation runout of the photoconductor drum 2, are canceled, thereby suppressing uneven image density.

[Adjustment Method 2]

Next, descriptions are given below of adjustment of developing bias and charging bias as first and second image forming conditions (hereinafter "adjustment method 2") for suppressing uneven image density resulting from the rotation runout of the photoconductor drum 2.

It is to be noted that, to simplify the description, the description below concerns suppressing uneven image density resulting from the rotation runout of the photoconductor drum 2. However, uneven image density resulting from the rotation runout of each of the photoconductor drum 2 and the developing roller 5*a* can be suppressed in a similar manner.

Figure 20:
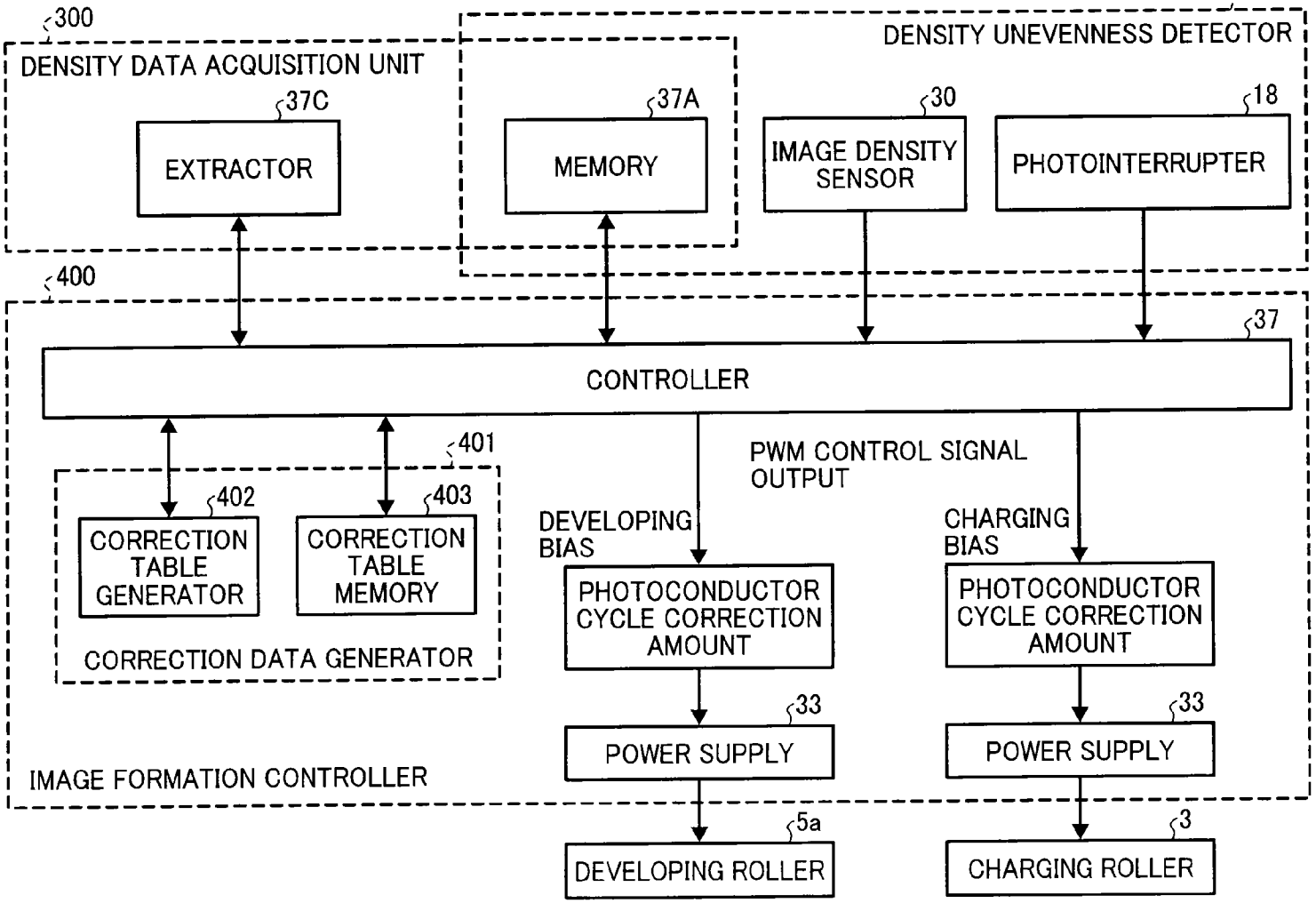
FIG. 20 is a block diagram illustrating a configuration to execute an adjustment method according to another embodiment.

FIG. 20 is a block diagram illustrating a configuration to execute the adjustment method 2.

In the adjustment method 2, a density unevenness detector 200 initially acquires data of image density unevenness including the rotation cycle component of the photoconductor drum 2 from the result (the adhesion amount detection signal SG2) of detection of the adjustment toner pattern 90, generated by the image density sensor 30. In the adjustment method 2, the density unevenness detector 200 includes the photointerrupter 18 (the rotation position detector) to detect the position in the direction of rotation of the photoconductor drum 2, the image density sensor 30 to detect the image density of the adjustment toner pattern 90, and the memory 37A to store the density unevenness data in which the image density detected by the image density sensor 30 is arranged in time series.

From the density unevenness data, a density data acquisition unit 300 extracts the density unevenness component having the rotation cycle of the photoconductor drum 2. In the adjustment method 2, the density data acquisition unit 300 includes an extractor 37C to extract, from the density unevenness data, the density unevenness component having the rotation cycle of the photoconductor drum 2, and the memory 37A, serving as the density unevenness data memory, to store the extracted density unevenness component.

An image formation controller 400 includes a correction data generator 401 to generate a correction table for each of the developing bias and the charging bias and a control unit to control the developing bias and the charging bias, roughly speaking. The correction data generator 401 includes a correction table generator 402 to generate the correction table for each of the developing bias and the charging bias, based on the density unevenness component extracted by the density data acquisition unit 300, and a correction table memory 403 to store the generated correction table. The control unit to control the developing bias and the charging bias includes the D/A converter 37B to convert the voltage, based on the correction table stored in the correction table memory 403, and the power supplies 33 to output the developing bias and the charging bias. Each of the developing bias and the charging bias is adjusted with the amount corresponding to the density unevenness component having the rotation cycle of the photoconductor drum 2 (photoconductor cycle correction amount) according to the correction table.

When the output from the power supplies 33 are controlled using the PWM control signal, the control unit to control the developing bias and the charging bias includes a PWM control signal generator to generate the PWM control signal to control the output voltage, based on the correction table stored in the correction table memory 403, and the power supplies 33 to output the developing bias and the charging bias.

The CPU of the controller 37 executes output of the developing bias and the charging bias (using A/D conversion or PWM control signal), input of the signal from the image density sensor 30 (A/D conversion), input of the rotation position detection signal SG1 of the rotary body (i.e., the photoconductor drum 2), computation of the correction table, reading from and writing in the memories, count of the number of times of the adjustment operation, time measurement using a timer, input of detection signals from a temperature and humidity sensor, and the like.

Figure 21:
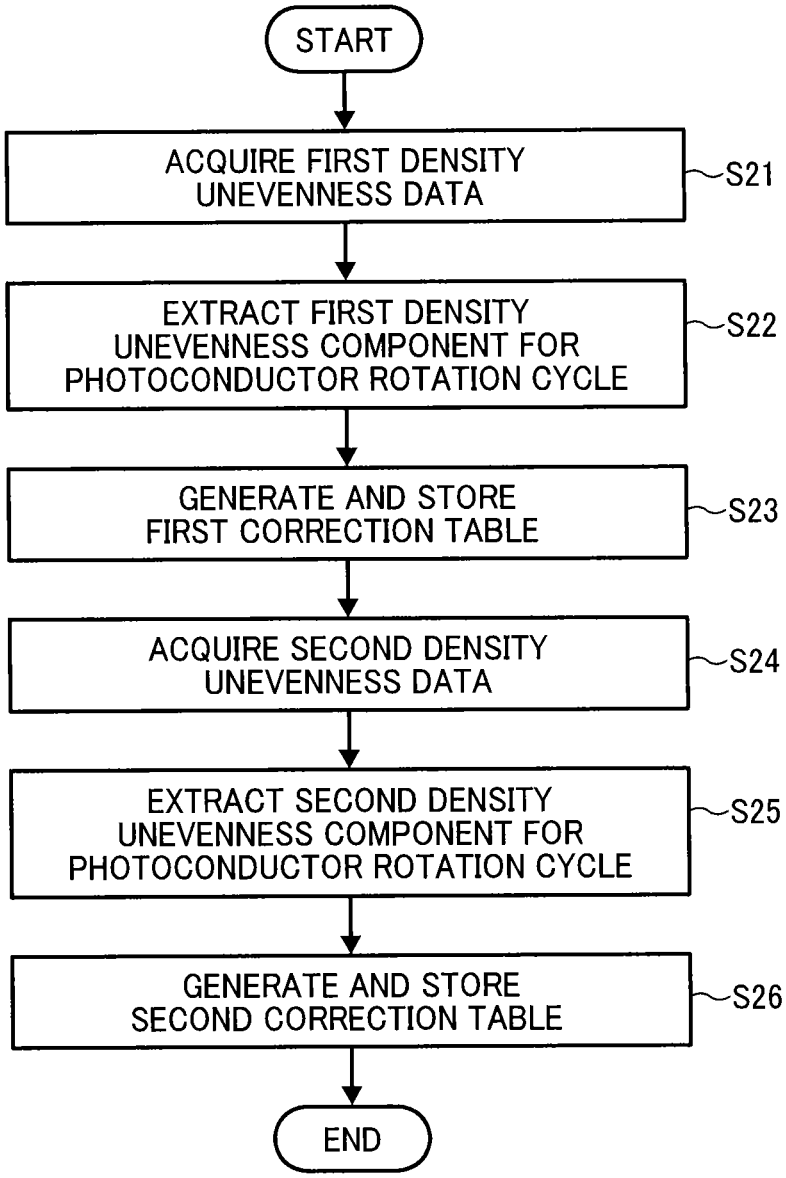
FIG. 21 is a flowchart of the adjustment method in the configuration illustrated in FIG. 20.

FIG. 21 is a flowchart of the adjustment method 2.

Initially, the toner image forming device 10 forms the solid images as the adjustment toner patterns 90 according to the image forming conditions determined by standard image quality adjustment (i.e., process control). At S21, the image density sensor 30 detects the adjustment toner patterns 90 and acquires first density unevenness data. The first density unevenness data is stored in the memory 37A. At S22, a first density unevenness component having the rotation cycle of the photoconductor drum 2 is extracted from the first density unevenness data stored in the memory 37A, with reference to the HP detection timing of the photoconductor drum 2, considering the linear velocity difference between the photoconductor drum 2 and the intermediate transfer belt 1. At S23, the correction table generator 402 generates a first correction table for the developing bias, based on the density unevenness component in the rotation cycle of the photoconductor drum 2 and stores the first correction table in the correction table memory 403.

Then, the controller 37 causes the toner image forming device 10 to form a halftone adjustment toner pattern, for example, having an image density of 50%, using the adjusted developing bias and the charging bias that is not adjusted, that is, determined by the standard image quality adjustment. At S24, the image density sensor 30 detects the halftone adjustment toner pattern and acquires second density unevenness data. The second density unevenness data is stored in the memory 37A. At S25, a second density unevenness component in the rotation cycle of the photoconductor drum 2 is extracted from the second density unevenness data stored in the memory 37A, with reference to the HP detection timing of the photoconductor drum 2, considering the linear velocity difference between the photoconductor drum 2 and the intermediate transfer belt 1. At S26, the correction table generator 402 generates a second correction table for the charging bias, based on the second density unevenness component in the rotation cycle of the photoconductor drum 2, and stores the second correction table in the correction table memory 403.

In the adjustment method 2, after the uneven image density is suppressed primarily by adjusting the first image forming condition (e.g., the developing bias), the uneven image density is further suppressed by adjusting the second image forming condition (e.g., the charging bias). It is to be noted that, the image forming condition or combination of image forming conditions is not limited thereto. Alternatively, the condition or conditions are selected or combined from 1) through 8) listed above.

However, an image density range where the background potential controlled by the charging condition is dominant is halftone or highlight portions. In addition, although the image density range controlled by the developing conditions and the like is a higher density range, and the adjustment toner pattern 90 is formed to have a higher image density, it is necessary to suppress uneven image density in a lower density range. Accordingly, the second image forming condition is preferably the charging bias, which is suitable for adjustment of unevenness in lower image density than the adjustment toner pattern 90. It is to be noted that, when the adjustment of the density unevenness due to changes in sensitivity of the photoconductor drum 2 corresponding to the image density is not considered, the image density range where the unevenness is suppressed by the first image forming condition can be lower in image density than the image density range where the unevenness is suppressed by the second image forming condition.

The uneven image density is recognized more in a higher density range. Accordingly, it is preferred that the first image forming condition be an image forming condition suitable for adjustment of unevenness in the higher density range, and the second image forming condition be an image forming condition suitable for adjustment of unevenness in a lower density range so that the resultant unevenness in the higher density range is secondarily adjusted by the second image forming condition.

In theory, it is possible to estimate influences of the adjustment of the first image forming condition (the developing bias in the adjustment method 2) on halftone or highlight portions of images. It is possible to calculate, using gain adjustment based on actual measurement, the influences on halftone or highlight portions of images caused by the adjustment of the first image forming condition (e.g., the developing bias) and the corresponding amount by which the second image forming condition is to be adjusted.

It is to be noted that, although the adjustment to suppress uneven image density is made in two stages using two image forming conditions in the adjustment method 2, the number of image forming conditions and the number of adjustment stages are not limited thereto.

For example, after the first correction table for the developing bias and the second correction table for the charging bias are generated in a manner similar to the adjustment method 2, a halftone adjustment toner pattern, for example, having an image density of 70% is formed using the adjusted developing bias and the adjusted charging bias. Then, the image density sensor 30 detects the halftone adjustment toner pattern and acquires third density unevenness data. The third density unevenness data is stored in the memory 37A. Subsequently, a third density unevenness component in the rotation cycle of the photoconductor drum 2 is extracted from the third density unevenness data stored in the memory 37A, with reference to the HP detection timing of the photoconductor drum 2, considering the linear velocity difference between the photoconductor drum 2 and the intermediate transfer belt 1. Then, the correction table generator 402 generates a third correction table for the exposure power (i.e., intensity of writing light), based on the density unevenness component in the rotation cycle of the photoconductor drum 2, and stores the third correction table in the correction table memory 403. This adjustment operation is effective in suppressing uneven image density in a wider density range, with a higher accuracy.

In the present embodiment, the correction table is generated, for example, immediately after the photoconductor drum 2 is set in the image forming apparatus 100 (in initial installation, replacement, removal and reinstallation for maintenance, or the like). This is because the possibility of occurrence of uneven image density in the rotation cycle of the photoconductor drum 2 is higher when the photoconductor drum 2 is mechanically removed. Additionally, it is possible that the relative positions of the photoconductor drum 2 and the photointerrupter 18 are changed. At the initial installation of the photoconductor drum 2, the correction table is not yet generated, and thus the correction table is to be generated. Since a new photoconductor drum 2 is different in runout characteristics, photosensitivity unevenness, or the like from the photoconductor drum 2 that has been used, the correction table is generated again in accordance with the new photoconductor drum 2 when the photoconductor drum 2 is replaced. Further, when the photoconductor drum 2 is removed for maintenance and then set in the apparatus, it is possible that the state of the photoconductor drum 2 changes. For example, the shaft of the photoconductor drum 2 differently deviates from the rotation axis thereof. Additionally, since the runout characteristics and the photosensitivity unevenness of the photoconductor drum 2 and the relative position of the photointerrupter 18 changes, the correction table is generated again. From the reasons described above, the correction table is generated immediately after the photoconductor drum 2 is set in the apparatus.

Additionally, in another embodiment, the correction table is generated each time the number of sheets printed reaches a predetermined number, instead of or in addition to the above-described timing. As the number of sheets printed increases, degradation of the photoconductor drum 2 progresses. Accordingly, it is possible that the photosensitivity unevenness changes. Further, it is possible that, while the photoconductor drum 2 is used for a long time, the positioning of the photoconductor drum 2 gradually changes. In this case, eccentricity of the photoconductor drum 2 is caused due to deviation between the shaft of the photoconductor drum 2 and the rotation axis thereof, and the relative positions of the photoconductor drum 2 and the photointerrupter 18 are changed. To inhibit influences caused by those changes, it is advantageous that the correction table is generated each time the number of sheets printed reaches a predetermined number.

Additionally, in another embodiment, the correction table is generated when an environment condition inside the apparatus changes, instead of or in addition to the above-described timing. Among environment conditions, in particular, when temperature changes, a base pipe of the photoconductor drum 2 expands or shrinks according to a coefficient of thermal expansion thereof. Accordingly, it is possible that an external profile of the photoconductor drum 2 changes, and the development gap fluctuates differently, causing changes in the occurrence of uneven image density. Generating the correction table upon changes in the environment conditions is advantageous in coping with this change.

Figure 22:
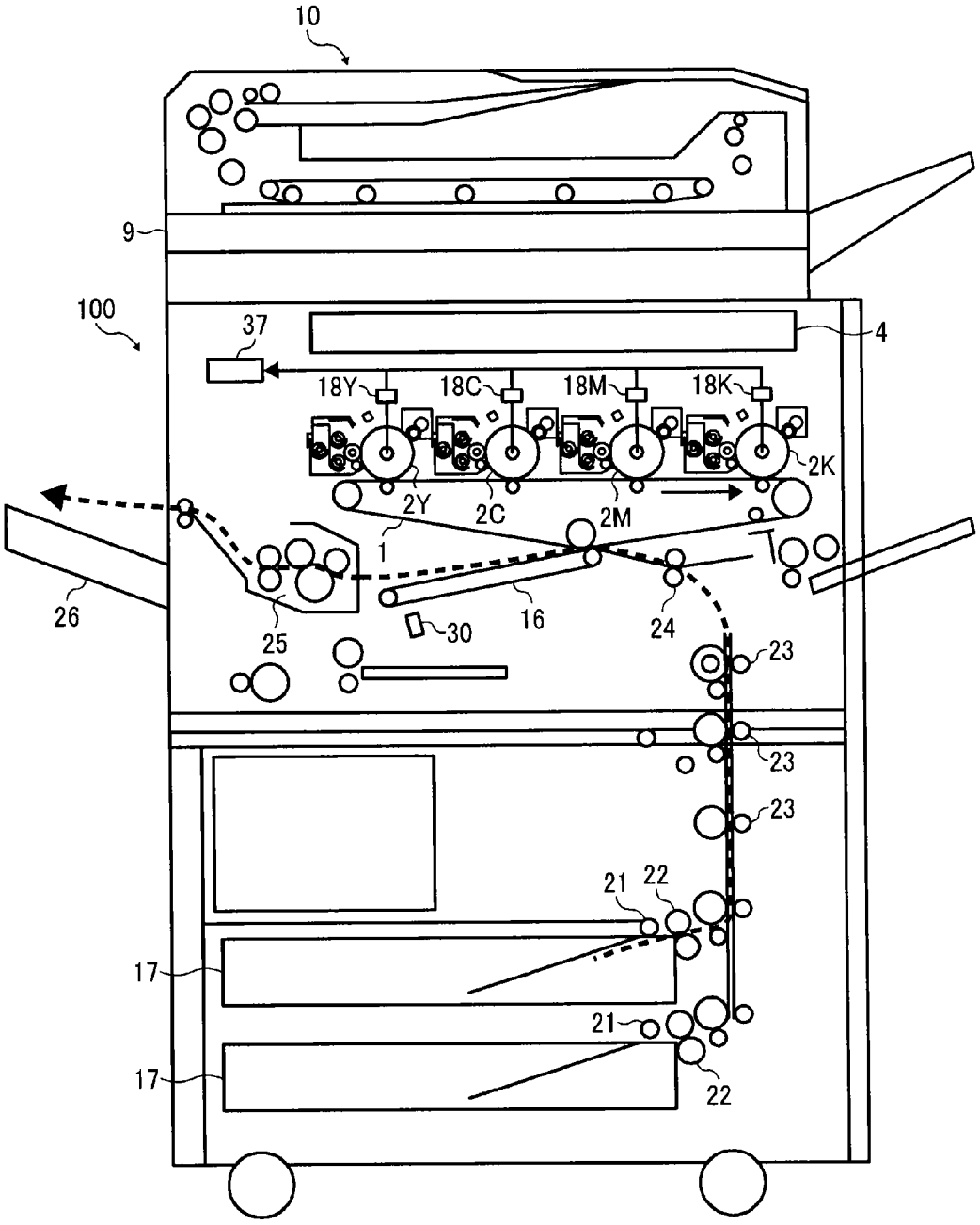
FIG. 22 is a schematic view illustrating a configuration of an image forming apparatus in which an image density of an adjustment toner pattern is detected on a secondary transfer belt.

Additionally, although the image density of the adjustment toner pattern is detected on the intermediate transfer belt 1 in the present embodiment, alternatively, the image density of the adjustment toner pattern may be detected on the secondary transfer belt 16 as illustrated in FIG. 22. In particular, when the intermediate transfer belt 1 is lower in surface gloss level, in some cases, the image density sensor 30 fails to detect the image density on the surface of the intermediate transfer belt 1.

In such a case, the adjustment toner pattern formed on the photoconductor drum 2 is transferred onto the intermediate transfer belt 1 and further transferred therefrom onto the secondary transfer belt 16, and the image density sensor 30 detects the image density of the adjustment toner pattern on the secondary transfer belt 16.

In this case, the secondary transfer belt 16 is preferably made of low-stretchable resin material, such as polyimide, in which carbon powder is dispersed to adjust electrical resistance. It is to be noted that, when the intermediate transfer belt 1 is different in linear velocity from the secondary transfer belt 16 in the configuration illustrated in FIG. 22, it is preferred that the correction table is generated considering this linear velocity difference therebetween as well.

The description above concerns suppression of uneven image density having the rotation cycle of the photoconductor drum 2 or the developing roller 5*a*. The uneven image density having the rotation cycle of other rotators, such as the charging roller 3 and the secondary transfer belt 16, can be suppressed by generating a correction table in a similar manner.

The present invention is not limited to the details of the example embodiments described above, and numerous additional modifications and variations are possible in light of the above teachings. It is therefore to be understood that, within the scope of the appended claims, the disclosure of this patent specification may be practiced otherwise than as specifically described herein.

For example, features of the present specification can adapt to image forming apparatuses having one of copying, printing, facsimile transmission, plotting and multifunction peripherals having those capabilities, such as color digital multifunction peripherals capable of full-color image formation. Alternatively, the image forming apparatus can be a multifunction peripheral having any combination of capabilities including a scanning capability and the above-mentioned capabilities. Although currently multicolor image forming apparatuses are dominant responding to market demands, features of the present specification can adapt to monochrome image forming apparatuses. Such image forming apparatuses are preferably capable of forming images on sheets of recording media such as overhead projector (OHP) sheets, thick paper including cards and postcards, and envelopes, in addition to plain paper. The image forming apparatuses can be either those capable of single-side printing or those capable of duplex printing.

Additionally, the features of the present specification can adapt to direct transfer type image forming apparatuses. In such a case, the toner image is transferred from the image bearer such as the photoconductor drum 2 onto a sheet conveyer (e.g., a conveyor belt) disposing to oppose to the photoconductor drum 2 in a manner similar to the manner of the intermediate transfer belt 1 illustrated in FIGS. 1 and 22.

The developer used in the image forming apparatus 100 is not limited to two-component developer. Alternatively, one-component developer may be used.

Additionally, effects of the embodiments mentioned above are examples, and effects attained by various aspects of this specification are not limited thereto. Each of the following aspects of this specification attains a specific effect.

Additionally, the steps in the above-described flowchart may be executed in an order different from that in the flowchart.

(Aspect A)

Aspect A concerns an image forming apparatus that includes an image bearer, such as the photoconductor drum 2 and the intermediate transfer belt 1, to bear an image and rotate (that is, the surface thereof moves); a toner image forming device, such as the charging roller 3Y, the optical writing unit 4, a developer bearer (the developing device 5Y), and the like, to form a toner image on the image bearer; a transfer rotator, such as the intermediate transfer belt 1 and the secondary transfer belt 16, that opposes to the image bearer and rotates; a transfer device to transfer the toner image from the image bearer onto either the transfer rotator (and further to a recording medium interposed between the transfer rotator and a sheet conveyor such as the secondary transfer belt 16), or a recording medium interposed between the image bearer and transfer rotator (or the sheet conveyor); a rotation position detector, such as the photointerrupters 18 and 71, to detect a reference rotation position (home position in the direction of rotation) of one of the image bearer (the photoconductor drum 2), the developer bearer, the sheet conveyor, and another rotator that contributes to image formation; an image density detector such as the image density sensor 30 to detect an image density of the toner image after the toner image is transferred from the image bearer; a density data acquisition unit, such as the controller 37, to cause the toner image forming device to form an adjustment toner image, such as adjustment toner pattern 90, having a length equal to or greater than a length of the image bearer in the direction of rotation thereof, on the image bearer for unevenness detection, and, according to a result of detection of the adjustment toner pattern, detected by the image density detector, acquires image density unevenness data with reference to the reference rotation position detected by the rotation position detector; a correction unit, such as the controller 37, to adjust an image forming condition to suppress the uneven image density having the rotation cycle of one of the image bearer, the developer bearer, the sheet conveyor, and another rotator, acquired from the image density unevenness data, with reference to the reference rotation position detected.

In such a configuration, the density data acquisition unit causes the transfer device to transfer the adjustment toner image onto the transfer rotator or the sheet conveyor, in a state in which there is a difference in linear velocity (surface movement speed) between the image bearer and the transfer rotator or the sheet conveyor.

The correction unit adjusts the image forming condition according to the difference in linear velocity in addition to the image density unevenness data and the reference rotation position detected.

According to Aspect A, since the adjustment toner image is formed in the state in which the image bearer is different in linear velocity from the transfer rotator or the sheet conveyor, the occurrence of image failure, such as wormhole images, in the adjustment toner image is suppressed. Further, even if the linear velocity difference is present during formation of the adjustment toner image, the image forming condition is adjusted considering the linear velocity difference. Consequently, the image forming condition is adjusted to inhibit the adjustment timing deviation caused by the linear velocity difference. Thus, image density unevenness can be suppressed.

(Aspect B)

In Aspect A, in standard image formation in which an image according to image data is transferred onto the recording medium, the transfer rotator or the sheet conveyor is different in linear velocity from the image bearer, and, when the adjustment toner image is transferred onto the transfer rotator or the sheet conveyor, the linear velocity difference is similar to the linear velocity difference in the standard image formation.

According to Aspect B, the occurrence of image failure in the adjustment toner image, such as wormhole images, is more reliably suppressed.

(Aspect C)

In Aspect B, when the adjustment toner image is transferred to either the transfer rotator or the sheet conveyor, the linear velocity of each of the image bearer and either the transfer rotator or the sheet conveyor is within about ±5.0% of the linear velocity thereof in the standard image formation.

(Aspect D)

In any of Aspects A through C, the toner image forming device includes a charger such as the charging roller 3 to charge the surface of the image bearer, a latent image forming device such as the optical writing unit 4 to form a latent image on the image bearer, and a developing device to develop the latent image with developer. The image forming condition adjusted by the correction unit is an operating condition of at least one of the charger, the latent image forming device, and the developing device.

According to Aspect D, the uneven image density can be suppressed by a relatively simple operation.

(Aspect E)

In any of Aspects A through D, the density data acquisition unit causes the toner image forming device to form multiple adjustment toner images respectively under different conditions and acquires multiple image density unevenness data from the respective adjustment toner images. The correction unit adjusts the image forming condition according to the multiple image density unevenness data, the reference rotation position, and the linear velocity difference.

According to Aspect E, as described above in the adjustment method 2, the uneven image density is suppressed in a wider density range, with a higher accuracy.

(Aspect F)

In any of Aspects A through E, the rotator, which is the target of the reference rotation position detected by the rotation position detector, is at least one of the image bearer, the transfer rotator, the sheet conveyor, and the developer bear to bear the developer thereon.

According to Aspect F, uneven image density that is more perceivable by a user is suppressed.

(Aspect G)

In any of Aspects A through F, the adjustment toner image is formed under conditions to attain a uniform image density.

According to Aspect G, acquisition of the image density unevenness data can be simplified.

(Aspect H)

In any of Aspects A through G, the transfer device transfers the toner image from the image bearer onto the transfer rotator and then onto the recording medium, and the image density detector detects the image density of the adjustment toner image on the transfer rotator. The density data acquisition unit causes the transfer device to transfer the adjustment toner image onto the transfer rotator in the state in which the image bearer is different in linear velocity from the transfer rotator.

According to Aspect H, in the image forming apparatus in which images are formed in the state in which the image bearer is different in linear velocity from the transfer rotator, the image density unevenness data is acquired with a higher accuracy, and the uneven image density is suppressed properly.

(Aspect I)

In any of Aspects A through G, the transfer device transfers the toner image from the image bearer onto the transfer rotator and then onto the recording medium conveyed on the surface of the sheet conveyor, and the image density detector detects the image density of the adjustment toner image on the sheet conveyor. The density data acquisition unit causes the transfer device to transfer the adjustment toner image in a state in which the linear velocity difference is present in at least one of a combination of the image bearer and the transfer rotator and a combination of the transfer rotator and the sheet conveyor.

According to Aspect I, in the image forming apparatus in which images are formed in the state in which the linear velocity difference is present in at least one of the combination of the image bearer and the transfer rotator and the combination of the transfer rotator and the sheet conveyor, the image density unevenness data is acquired with a higher accuracy, and the uneven image density is suppressed properly.

(Aspect J)

In any of Aspects A through I, the correction unit causes the density data acquisition unit to start acquisition of the image density unevenness data at a time point shifted by an amount corresponding to the linear velocity difference, with reference to the reference rotation position, from the timing for the case where the linear velocity difference is not present, and starts adjusting the image forming condition with reference to the reference rotation position.

According to this aspect, the image forming condition is adjusted to inhibit the adjustment timing deviation caused by the linear velocity difference, and uneven image density is suppressed properly.

(Aspect K)

In any of Aspects A through I, the correction unit causes the density data acquisition unit to start acquisition of the image density unevenness data at the timing with reference to the reference rotation position for the case where the linear velocity difference is not present, and starts adjusting the image forming condition at a time point shifted by an amount corresponding to the linear velocity difference from the timing with reference to the reference rotation position, for the case where the linear velocity difference is not present.

According to this aspect, the image forming condition is adjusted to inhibit the adjustment timing deviation caused by the linear velocity difference, and uneven image density is suppressed properly.

What is claimed is:

1. An image forming apparatus comprising:

an image bearer to rotate;

a toner image forming device to form a toner image on the image bearer;

a transfer rotator disposed opposing to the image bearer;

a transfer device to transfer the toner image from the image bearer onto either the transfer rotator or a recording medium conveyed on the transfer rotator;

a rotation position detector to detect a reference rotation position of one of the image Bearer and a rotator that contributes to image formation;

an image density detector to detect an image density of the toner image transferred from the image bearer;

circuitry configured to:

cause the toner image forming device to form an adjustment toner image equal to or greater in length than the image bearer in a rotation direction of the image bearer, cause a linear velocity difference between the image bearer and the transfer rotator in transfer of the adjustment toner image, acquire, from a detection result of the adjustment toner image generated by the image density detector, image density unevenness data with reference to detection of the reference rotation position, the image density unevenness data including an image density unevenness component having a rotation cycle of the one of the image bearer and the rotator, and adjust an image forming condition according to the detection of the reference rotation position, the image density unevenness data, and the linear velocity difference, wherein the circuitry recognizes, based on the detection of the reference rotation position, a reference arrival time at which the adjustment toner image is to arrive at a detection position of the image density detector in a state in which the image bearer is identical in linear velocity with the transfer rotator, the circuitry starts acquisition of the image density unevenness data at the reference arrival time, and the circuitry starts adjusting the image forming condition at a time point shifted from the reference arrival time by an amount corresponding to the linear velocity difference.

2. The image forming apparatus according to claim 1, wherein the transfer rotator is different in linear velocity from the image bearer in standard image formation, and the linear velocity difference between the image bearer and the transfer rotator in transfer of the adjustment toner image is substantially equal to the linear velocity difference between the image bearer and the transfer rotator in the standard image formation.

3. The image forming apparatus according to claim 2, wherein the linear velocity of each of the image bearer and the transfer rotator in transfer of the adjustment toner image is within about ±5.0% of the linear velocity thereof in standard image formation.

4. The image forming apparatus according to claim 1, wherein the toner image forming device comprises:

a charger to charge a surface of the image bearer;

a latent image forming device to form a latent image on the image bearer; and a developing device to develop the latent image with developer, and the image forming condition adjusted by the circuitry includes an operating condition of at least one of the charger, the latent image forming device, and the developing device.

5. The image forming apparatus according to claim 1, wherein the circuitry causes the toner image forming device to form multiple adjustment toner images respectively under different conditions and acquire multiple image density unevenness data from the respective adjustment toner images, and the circuitry adjusts the image forming condition according to the multiple image density unevenness data, the detection of the reference rotation position, and the linear velocity difference.

6. The image forming apparatus according to claim 1, wherein the rotator comprises at least one of a developer bearer to bear developer thereon and a sheet conveyor to oppose to the transfer rotator and to transport the recording medium thereon.

7. The image forming apparatus according to claim 1, wherein the circuitry causes the toner image forming device to form the adjustment toner image under conditions to attain a uniform image density.

8. The image forming apparatus according to claim 1, wherein the transfer device transfers the toner image from the image bearer onto the transfer rotator and further transfers the toner image onto the recording medium, and the image density detector detects an image density of the adjustment toner image on the transfer rotator.

9. The image forming apparatus according to claim 1, further comprising a sheet conveyor to rotate, disposed opposing to the transfer rotator, wherein the transfer device transfers the toner image from the image bearer onto the transfer rotator and further transfers the toner image onto the recording medium conveyed on a surface of the sheet conveyor, the circuitry causes the transfer device to transfer the adjustment toner image from the transfer rotator onto the sheet conveyor, the image density detector detects an image density of the adjustment toner image on the sheet conveyor, and the circuitry causes a linear velocity difference between the transfer rotator and the sheet conveyor in transfer of the adjustment toner image.

10. The image forming apparatus according to claim 1, wherein the circuitry recognizes, based on the detection of the reference rotation position, a reference arrival time at which the adjustment toner image is to arrive at a detection position of the image density detector in a state in which the image bearer is identical in linear velocity with the transfer rotator, the circuitry starts acquisition of the image density unevenness data at a time point shifted from the reference arrival time by an amount corresponding to the linear velocity difference, and the circuitry starts adjusting the image forming condition with reference to the detection of the reference rotation position.

11. An image forming apparatus comprising:

an image bearer to rotate;

a toner image forming device to form a toner image on the image bearer;

a transfer rotator disposed opposing to the image bearer;

a sheet conveyor to rotate, disposed opposing to the transfer rotator;

a transfer device to transfer the toner image from the image bearer onto the transfer rotator and further onto a recording medium conveyed on the sheet conveyor;

a rotation position detector to detect a reference rotation position of at least one of the image bearer, the sheet conveyor, and a rotator that contributes to image formation;

an image density detector to detect an image density of the toner image transferred from the image bearer;

circuitry configured to:

cause the toner image forming device to form an adjustment toner image equal to or greater in length than the image bearer in a rotation direction of the image bearer, cause a linear velocity difference one of between the image bearer and the transfer rotator, and between the transfer rotator and the sheet conveyor in transfer of the adjustment toner image, acquire, from a detection result of the adjustment toner image generated by the image density detector, image density unevenness data with reference to detection of the reference rotation position, the image density unevenness data including an image density unevenness component having a rotation cycle of the one of the image bearer, the sheet conveyor, and the rotator, and adjust an image forming condition according to the detection of the reference rotation position, the image density unevenness data, and the linear velocity difference, wherein the circuitry recognizes, based on the detection of the reference rotation Position, a reference arrival time at which the adjustment toner image is to arrive at a detection position of the image density detector in a state in which the image bearer is identical in linear velocity with the transfer rotator, the circuitry starts acquisition of the image density unevenness data at the reference arrival time, and the circuitry starts adjusting the image forming condition at a time point shifted from the reference arrival time by an amount corresponding to the linear velocity difference.

12. A method of adjusting an image forming condition, the method comprising:

forming an adjustment toner image on an image bearer, the adjustment toner image equal to or greater in length than the image bearer in a rotation direction of the image bearer;

transferring the adjustment toner image from the image bearer onto a transfer rotator in a state in which a linear velocity difference is present between the image bearer and the transfer rotator;

detecting a reference rotation position of one of the image bearer and a rotator that contributes to image formation;

detecting an image density of the adjustment toner image on the transfer rotator;

acquiring, from the image density detected, image density unevenness data with reference to detection of the reference rotation position, the image density unevenness data including an image density unevenness component having a rotation cycle of the one of the image bearer and the rotator;

adjusting the image forming condition according to the detection of the reference rotation position, the image density unevenness data, and the linear velocity difference recognizing, based on the detection of the reference rotation position, a reference arrival time at which the adjustment toner image is to arrive at a detection position of the image density detector in a state in which the image bearer is identical in linear velocity with the transfer rotator;

starting acquisition of the image density unevenness data at the reference arrival time; and starting adjusting the image forming condition at a time point shifted from the reference arrival time by an amount corresponding to the linear velocity difference.

13. An image forming apparatus comprising:

an image bearer to rotate;

a toner image forming device to form a toner image on the image bearer;

a transfer rotator disposed opposing to the image bearer;

a transfer device to transfer the toner image from the image bearer onto either the transfer rotator or a recording medium conveyed on the transfer rotator;

a rotation position detector to detect a reference rotation position of one of the image bearer and a rotator that contributes to image formation;

an image density detector to detect an image density of the toner image transferred from the image bearer;

circuitry configured to:

cause the toner image forming device to form an adjustment toner image equal to or greater in length than the image bearer in a rotation direction of the image bearer, cause a linear velocity difference between the image bearer and the transfer rotator in transfer of the adjustment toner image, acquire, from a detection result of the adjustment toner image generated by the image density detector, image density unevenness data with reference to detection of the reference rotation position, the image density unevenness data including an image density unevenness component having a rotation cycle of the one of the image bearer and the rotator, and adjust an image forming condition according to the detection of the reference rotation position, the image density unevenness data, and the linear velocity difference, wherein the circuitry recognizes, based on the detection of the reference rotation position, a reference arrival time at which the adjustment toner image is to arrive at a detection position of the image density detector in a state in which the image bearer is identical in linear velocity with the transfer rotator, the circuitry starts acquisition of the image density unevenness data at a time point shifted from the reference arrival time by an amount corresponding to the linear velocity difference based on the detection of the reference rotation position, and the circuitry starts adjusting the image forming condition with reference to the detection of the reference rotation position.

* * * * *